US008756889B2

(12) United States Patent
LeBlang

(10) Patent No.: US 8,756,889 B2
(45) Date of Patent: Jun. 24, 2014

(54) METAL STUD BUILDING PANEL WITH FOAM BLOCK CORE

(76) Inventor: Dennis LeBlang, Palm Desert, CA (US)

( * ) Notice: Subject to any disclaimer, the term of this patent is extended or adjusted under 35 U.S.C. 154(b) by 0 days.

(21) Appl. No.: 13/398,168

(22) Filed: Feb. 17, 2012

(65) Prior Publication Data

US 2012/0174512 A1 Jul. 12, 2012

Related U.S. Application Data

(63) Continuation-in-part of application No. 12/456,707, filed on Jun. 22, 2009, now Pat. No. 8,161,699, and a continuation-in-part of application No. 12/231,875, filed on Sep. 8, 2008, now Pat. No. 8,176,696.

(51) Int. Cl.
*E04C 1/42* (2006.01)

(52) U.S. Cl.
USPC ..... 52/309.12; 52/252; 52/309.4

(58) Field of Classification Search
USPC ..... 52/251, 252, 258, 259, 260, 309.4, 52/309.7
See application file for complete search history.

(56) References Cited

U.S. PATENT DOCUMENTS

| | | | | |
|---|---|---|---|---|
| 5,279,088 | A | 1/1994 | Heydon | |
| 5,353,560 | A | 10/1994 | Heydon | |
| 5,497,589 | A | 3/1996 | Porter | |
| 5,505,031 | A | 4/1996 | Heydon | |
| 5,628,158 | A | 5/1997 | Porter | |
| 5,638,651 | A | 6/1997 | Ford | |
| 5,722,198 | A | 3/1998 | Bader | |
| 5,842,276 | A | 12/1998 | Asher | |
| 5,943,775 | A | 8/1999 | Lanahan | |
| 5,950,389 | A | 9/1999 | Porter | |
| 6,044,603 | A | 4/2000 | Bader | |
| 6,167,624 | B1 | 1/2001 | Lanahan | |
| 6,256,960 | B1 | 7/2001 | Babcock | |
| 6,269,608 | B1 | 8/2001 | Porter | |
| 6,308,491 | B1 | 10/2001 | Porter | |
| 6,408,594 | B1 | 6/2002 | Porter | |
| 6,564,521 | B1 | 5/2003 | Brown | |
| 6,584,742 | B1 | 7/2003 | Kligler | |
| 6,701,684 | B2 | 3/2004 | Sadler | |
| 6,880,304 | B1 | 4/2005 | Budge | |
| 7,395,999 | B2 | 7/2008 | Walpole | |
| 8,109,058 | B2 * | 2/2012 | Miller | 52/309.7 |
| 2007/0227086 | A1 * | 10/2007 | Beavers et al. | 52/309.7 |

OTHER PUBLICATIONS

US 5,824,314, 10/1998, Porter (withdrawn)

* cited by examiner

*Primary Examiner* — Brian Glessner
*Assistant Examiner* — Daniel Kenny

(57) ABSTRACT

A building panel using spacer blocks that fit between channels wherein the spacer blocks interlock and slid together between the support channels. The spacer blocks interlock horizontally and vertically using a means of forming a tongue and groove connection between the spacer blocks and between the framing members. Various interlocking tongue and groove connections form different wall structures and horizontal bracing channels along with the horizontal tongue and trough add flexibility. Metal channels and wood are used as framing members and the structural insulating core assembly can form structural insulated panels (SIP's). A coupling is used to connect vertical framing members and brackets are shown connecting spacer blocks than full height framing members.

9 Claims, 25 Drawing Sheets

METAL STUD BUILDING PANEL WITH FOAM BLOCK CORE

REFERENCE TO RELATED APPLICATIONS

This application is a continuation-in-part of patent application Ser. No. 12/456,707 filed Jun. 22, 2009 now U.S. Pat. No. 8,161,699 and Ser. No. 12/231,875 filed on Sep. 8, 2008 now U.S. Pat. No. 8,176,696.

FEDERALLY SPONSORED RESEARCH OR DEVELOPMENT

Not Applicable.

PARTIES OR JOINT RESEARCH

Not Applicable.

FIELD OF THE INVENTION

The present invention relates to an improved wall system where a building panel using a tongue and groove assembly of foam spacers that interlock and slide together with support channels that when assembled form a structural insulating core. The structural insulating core wall is used as an independent framed wall, or in combination of an independent wall and a Insulated Concrete Form (ICF) wall, in conjunction as part of a precast wall or as part of forming system to form a concrete beam and column structure. To further enhance the structural insulating core, interior and exterior rigid boards (like plywood or drywall) can be assembled to form a building panel or glued together to form a Structural Insulated Panel (SIP) or rigid materials can be added at the project site. Horizontal projections on the foam spacers and indentations can be added to the tongue and groove assembly of the foam spacers to overlap the support channels to reduce air infiltration between foam spacer. The horizontal projections can be installed on the tongue side or groove side of the foam spacer for various configurations. The foam spacer can also interlock together when a horizontal tongue of one block fits into a groove of an adjacent block. Different shaped support channels are available and wood supports are also incorporated for different building panel requirements.

BACKGROUND OF THE INVENTION

Exterior metal framing has always been difficult to insulate because of the configuration of the support channels like a C channel. The lip and flange of the C channel protrudes from the web making it difficult to insulate. When horizontal bracing channels are installed between support channels for additional strength, insulation became even more difficult to install as well as form a good insulated wall.

Closed cell rigid insulation has been increasing in popularity, however the solutions has been to mold the closed cell insulation into the support channels. In addition, closed cell rigid insulation has been cut into panels where several support channels slide into the rigid insulation panel from the top of the rigid insulation in order to install the support channels. The closed cell rigid insulation solutions are usually installed in a manufacturing plant rather that at the job site.

The creation of a smaller spacer blocks that has flexibility to be assembled into panels at a manufacturing plant or at the construction site as well as incorporating various types of horizontal bracing channels and electrical chases or troughs gives the spacer block additional flexibility. In addition, the size of the spacer block can vary depending on the type of closed cell rigid insulation is used like polystyrene, cellular light weight concrete or aerated autoclaved concrete.

The horizontal bracing channels within the wall forming structure is generally provided by installing bridging members which tie the support channels together. These bridging members may be attached on the outside of the flanges of the support channels or maybe internal bridging members installed through openings provided in the web of the support channels. None of the bridging members used today have a limited function and do not provide a solution for interacting with rigid insulation between support channels and the holes the internal bridging members pass through.

The construction of a wall varies based on the type of materials that are used. For example a solid concrete or masonry wall does not need to be laterally supported, because the wall is connected horizontally from say one masonry block to another masonry block. On the other hand, a post and beam type construction needs to be horizontally braced somewhere within that building otherwise the building would collapse if the wind or an earthquake would cause the building to move horizontally. Usually that is done by adding diagonal braces that criss-cross between the columns or by adding a solid wall somewhere within the building structure. When a smaller wood or metal framed wall has a similar problem, that is, the framing members need to be supported between each other using by applying plywood over the framing members. The plywood acts a shear wall, by not allowing the framing members to fall down like "domino's".

Structural insulated panels or SIP's have a foam core with exterior skins usually plywood glued to the foam. Sometimes metal or wood is installed within the foam core and the wood or metal is connected between the panels for additional support. SIP's have a very limited load bearing capacity due to the structural limitation in the design of the panels. The use of SIP's have been limited to one or two story building and have never been used in conjunction with precast or poured-in-place concrete walls.

DESCRIPTION OF PRIOR ART

A. Foam Block With Holes

In U.S. Pat. No. 5,842,276 by Ashner cuts a hole in a larger block so a conduit can be installed. The block remains as one piece and a tongue and groove connection is not incorporated in the assembly of the synthetic panel.

In U.S. Pat. No. 7,028,440 (filed Nov. 29, 2003) by Brisson uses foam blocks with vertical holes to form concrete columns and uses a horizontal recess at the top of the panels to form a beam pocket. The foam panels are made using a tongue and groove type connections between panels and the panels are glued together. Since the holes for the concrete are only support by foam, the size is limited as the concrete will deform as well as break the foam panels. Again the beam pocket is also fragile as there is not support to stop the wet concrete from deforming the beam.

B. Foam Panel

In U.S. Pat. No. 5,943,775 (filed Jan. 7, 1998) and U.S. Pat. No. 6,167,624 (filed Nov. 3, 1999) by Lanahan uses a polymeric foam panel with metal channels installed within the foam. The panels are interlocked together by a tongue and groove connection using the foam as the connector. An electrical conduit is horizontally installed within the panel for electrical distribution. The metal channels are embedded within the foam. None of the Lanahan patents use their panels to form concrete columns or beams. Walpole in U.S. Pat. No. 7,395,999 embeds a metal channel in foam for support and uses a tongue & groove joint sealer between panels. In U.S. Pat. No. 5,722,198 (filed Oct. 7, 1994) and U.S. Pat. No. 6,044,603 (filed Feb. 27, 1998) by Bader discloses a panel & method to form a metal channel and foam panel where the flanges are embedded into the sides of the foam panels. In U.S. Pat. No. 5,279,088 (filed Jan. 17, 1992), U.S. Pat. No. 5,353,560 (filed Jun. 12, 1992) and U.S. Pat. No. 5,505,031 (filed May 4, 1994) by Heydon show a wall and panel structures using overlapping foam and metal channels in various configurations.

C. SIP

Structural insulated panels known as SIP's are typically made using rigid insulation in the middle with plywood on both sides and wood blocking or metal connectors are installed in the middle connecting the two panels together.

Porter has developed many SIP patents using metal components including U.S. Pat. No. 5,497,589, U.S. Pat. No. 5,628,158, U.S. Pat. No. 5,842,314, U.S. Pat. No. 6,269,608, U.S. Pat. No. 6,308,491, and U.S. Pat. No. 6,408,594 as well as Babcock U.S. Pat. No. 6,256,960, Brown U.S. Pat. No. 6,564,521 and Kligler U.S. Pat. No. 6,584,742 of which Babcock shows a metal channel between two panels to interlock adjacent panels. In U.S. Pat. No. 5,638,651 uses metal channels at interior but does not have a thermal break on the metal channels. Porter shows 5 more patents using wood and one more U.S. Pat. No. 5,950,389 using splines to interlock panels.

D. Panel Construction

In U.S. Pat. No. 5,638,651 filed Jun. 21, 1996 by Ford uses an interlocking panel system where two U channels interlocks with an OSB board and the metal channel to form a building panel. In U.S. Pat. No. 6,701,684 filed Jun. 26, 2002 by Stadler uses vertical back to back U metal channels in a foam panel and a cementous coating over the foam to form a wall. In U.S. Pat. No. 6,880,304 filed Sep. 9, 2003 by Budge uses a vertical slotted frame to support a foamed wall assembly.

SUMMARY OF THE INVENTION

A building panel using foam spacers that fit between support channels wherein the foam blocks interlock and slid together between the support channels. The foam spacer have vertical and horizontal interlocking tongue and groove connections that connect between the wall forming structure and the foam spacers. The foam spacers can cover the flanges of the support channels or just protrude beyond the support channels to form a thermal break.

Another variation of the invention is when the foam spacers are wider than the support channels, and overlap the flanges of the support channels in various different ways. The inner and outer boards that are installed over the foam spacers are not in contact with the support channels and create a thermal break in the improved wall system.

Brackets which are shorter than full height support channels can be used when constructing a wall forming structure. The brackets also have a hole into which the horizontal bracing channel can connect to allowing the foam spacers to be secured together when load bearing materials can be used rather than closed cell insulation materials.

Another aspect of the invention is that exterior wall sheathing and interior rigid insulation in a wall are formed as one and together form an integrated material referred to a foam spacer. The integrated wall sheathing speeds construction since usually two different construction trades installs the wall sheathing and the interior insulation and the foam spacers provides a measurement say 16" or 24" on center for a faster wall installation.

Another aspect of the pending patents it the formation of a structural insulating panel (SIP) when the structural insulating core and the rigid board and rigid insulating are all glued together.

Another aspect of the invention is that the projection of the foam spacers can be located on the tongue side or groove side of the spacer blocks.

Another aspect of the invention is that wood supports can be substituted for support channels and horizontal projections and troughs can also be used between the wood supports.

Another aspect of the invention is that the foam spacers can be full height between the top and bottom base plate.

Another aspect of the pending patent is that the spacer foam can be formed to include the area shown as the foam material creating the thermal break between the wall forming structures as well as an insulated wall. This structural insulating core of channels and foam spacer can be used as the center core of a concrete column and beam wall mold or as just a framed wall using the support channels and either spacer insulation or foam spacer for a conventional framed wall. The spacer insulation is formed using tongue and groove sides so as to easily slide into place between the channels. This interlocking foam core can glue together to form panels as well as to form structural insulated panels (SIP's) with the exterior and interior faces glue together to form one panel.

Another aspect of the invention is to form thin-cast precast walls using the structural insulating core and a forming bed when pouring the concrete over the top (face up) on to the structural insulating core. Additional columns and beams can be formed by removing sections of the foam spacer integrating the columns, beams or ribs into the thin-cast concrete face of the precast panel.

DESCRIPTION OF THE PREFERRED EMBODIMENTS

Figure 1:
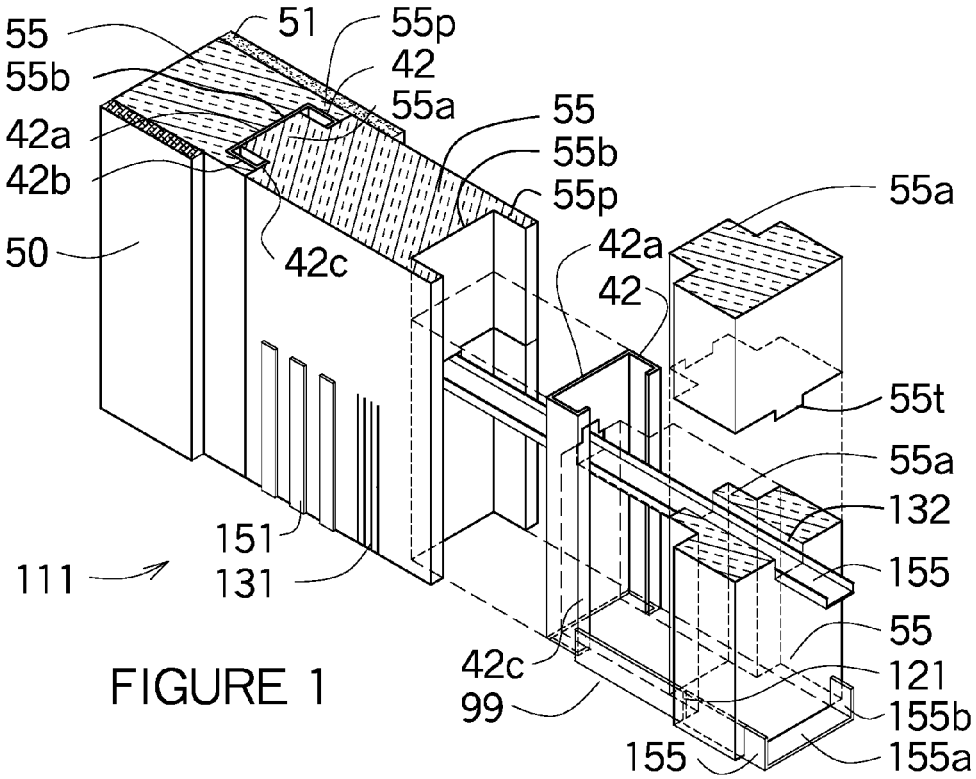
FIG. 1 shows an isometric view of the structural insulating wall where the foam spacers are wider and interlock between the support channels and horizontal bracing channels and horizontal tongue fit into a trough of the foam spacers connecting to the support channels together along with the base plate connections to the foam spacers and support channels.
Figure 3:
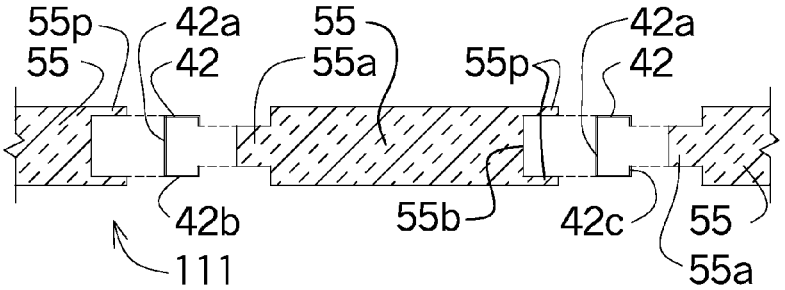
FIG. 3 shows a plan view of the overlapping projections of the thinner tongue space and groove space of the foam spacer with a C channel wall structure.

FIG. 1 shows an isometric drawing of the building panel and FIG. 3 shows a plan view of the building panel with the structural insulating core 111 of vertical support channels supporting wall structure and the foam spacers 55 fitting between the C channels 42. The left side shows the building panel assembled and the right side shows the various wall components separated. The right side shows the support channel as a C channel 42 with the horizontal bracing channel shown as a horizontal U channel 155 passing through the hole 36 in the web 42*a* of the C channel 42. On both sides of the C channel 42 are foam spacers 55 that have a trough 132 at the top of each foam spacer 55. The horizontal U channel 155 fits through the hole 36 and into the troughs 132 of the foam spacers 55. Another foam spacer 55 is shown above the horizontal U channel 155 where a horizontal tongue 55*t* fits into the trough 132 of the foam spacer 55 below. The trough 132 is deeper than the horizontal U channel 155 so to allow space for any mechanical/electric utilities to pass through. All the foam spacers 55 are shown deeper than the length of the web 42*a* of the support channel so projection 55*p* can extend over the flanges 42*b* of the C channel 42. The foam spacers 55 have a tongue shape 55*a* that fits between the lips 42*c* and abut the webs 42*a* and the lip 42*c* of the C channels 42 and a groove shape 55*b* where the groove shape abuts the web 42*a* of the C channel 42 and the projections 55*p* of the foam spacer 55 extends over the flanges 42*b* of the C channel 42 abutting the adjacent foam spacer 55. The base plate 120 is shown also as a horizontal U channel 155, however the web 155*a* is secured to a floor and the webs 155*b* are attached to the flanges 42*b* of the C channel 42 and the flanges 42*b* also slide into a groove 121 at the bottom of the foam spacer 55. The left side of FIG. 1 shows the wall panel consisting of the structural insulating core 111 assembled together with the rigid board 50 and rigid insulation 51 are the inner and outer rigid boards that define the outer surfaces of the wall panel (the top of the wall panel base plate is not shown). Also shown are drainage channels 151 that protrude from the structural insulating core 111 to create an air space should it be required when some exterior surface finish materials (not shown) are applied over the structural insulating core 111. In addition a recessed groove 133 is shown on the exterior face of the structural insulating core 111 to allow water drainage between the structural insulating core 111 and various stucco applications. The recessed grooves 133 and drainage channels 151 can be added to become accents at the exterior face of the structural insulating core 111.

Figure 2:
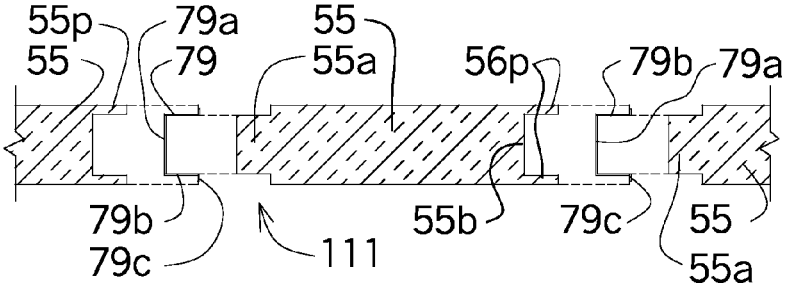
FIG. 2 show a plan view with the tongue and groove assembly using the reverse lip channel as the support channel of the structural insulating core.

FIG. 2 shows a plan view of FIG. 1 except here two reverse lip channels 79 are used between three foam spacer 55. The reverse lip channel 79 is similar to the C channel 42 in FIG. 1, except the lip 79*c* is bent in the opposite direction as the lip 42*c*. The tongue shape 55*a* fits against the web 79*a* of the reverse lip channels 79 and the groove shape 55*b* fits against the adjacent reverse lip channel 79 at the web 79*a* and the projection 55*p* of the foam spacer 55 fits against the flanges 79*b* and abuts the lip 79*c*. Since the structural insulating core 111 has a snug fit between the reverse lip channels 79 and the foam spacers 55, the wall panel can be glued together. The reverse lip channel 79 and the C channel 42 have the same physical characteristics since the lip 79*c* & 42*c* function in the same way giving the reverse lip channel 79 the same strength as the C channel 42. In addition, the reverse lip channel 79 can also be use in place of the horizontal bracing channel where ever it has been used.

Figure 4:
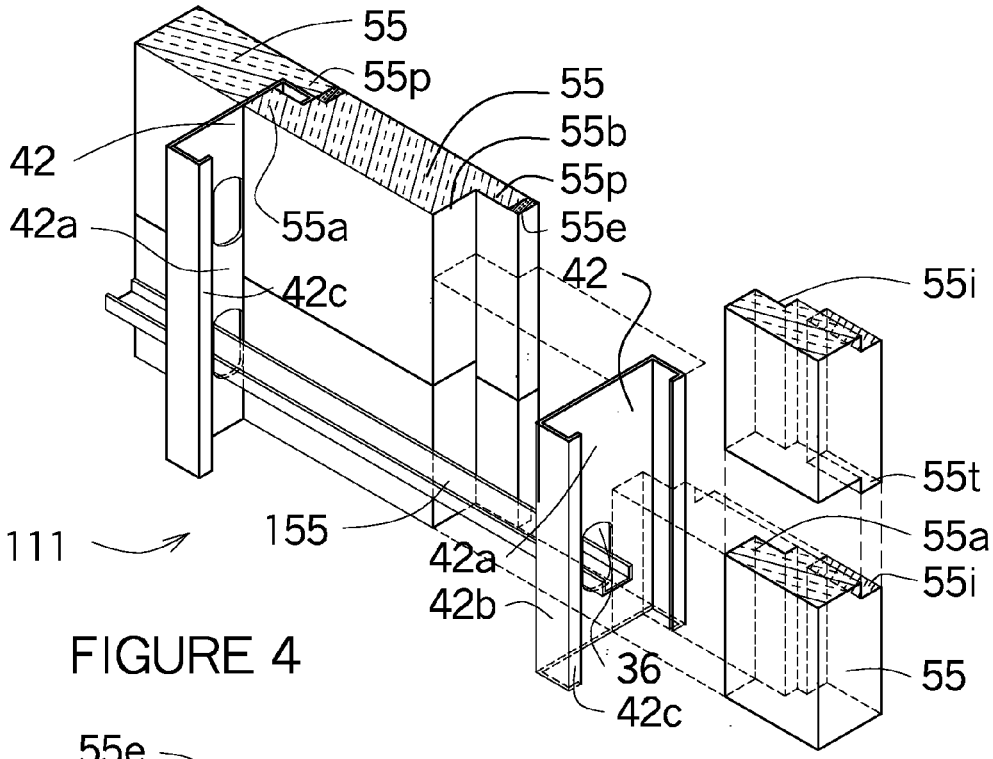
FIG. 4 shows an isometric view of a half wall and the tongue and groove connection between the foam spacers.
Figure 5:
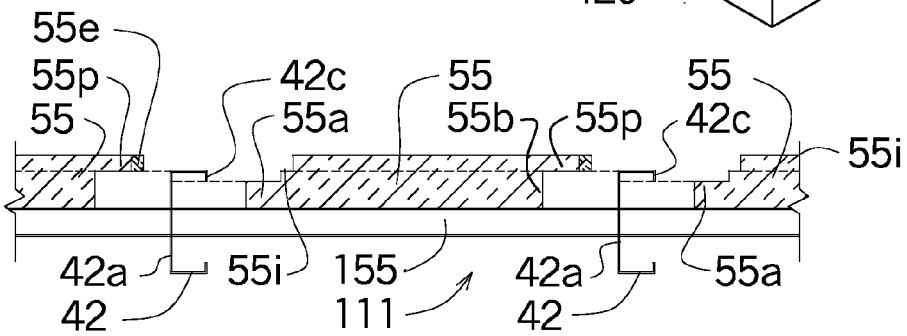
FIG. 5 is a plan view showing the half wall with the tongue and groove connection and the horizontal bracing channel supporting the foam spacers.

FIG. 4 is similar to FIG. 1 except the four foam spacers 55 of the structural insulating core 111 is less than the thickness of the foam spacers 55 in FIG. 1. The groove shape 55*b* of the foam spacer 55 has a projection 55*p* and extension 55*e* that extends beyond the webs 42*a* of the adjoining C channels 42 enough to create a thermal break and cover the C channels 42. The open portion of the C channel 42 has a web 42*a* and a lip 42*c* where the tongue shape 55*a* fits against and between and a horizontal bracing channel shown as horizontal U channel 155 (typically used to connect adjacent C channels within the building industry) and an indentation 55*i* where the extension 55*e* fits against. Since the foam spacers 55 overlaps the C channel 42 at the projection 55*p* and fits between the webs 42*a*, the foam spacer 55, the foam spacer 55 becomes a wall insulation as well as a wall sheathing material all made together as one material. The vertical connection between the foam spacers 55 has a horizontal tongue 55*t* the width of the projection 55*p* and extends downward into the indentation 55*i* of the foam spacer 55 below. FIG. 5 is a plan view of the wall panel showing the tongue shape 55*a* and groove shape 55*b* and the projection 55*p* and extension 55*e* of the foam spacer 55 between the C channels 42 as shown also in FIG. 4.

Figure 6:
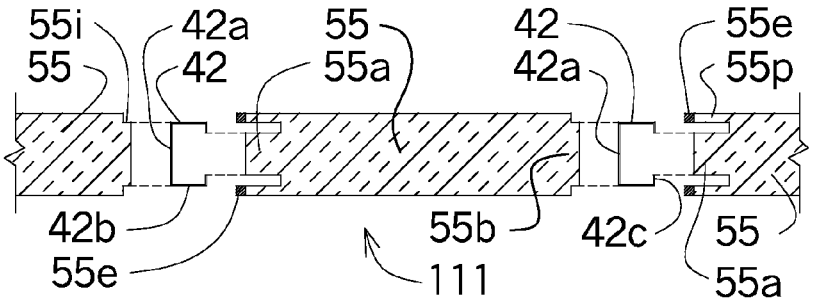
FIG. 6 shows a plan view of the foam spacer with the projection and extension on the tongue side of the foam spacer.

FIG. 6 shows a plan view of a structural insulating core 111 with an alternated shape for the foam spacer 55. The foam spacer 55 shows the tongue shape 55*a* with the projection 55*p* and extension 55*e* on the same side of the foam spacer 55. The tongue shape 55*a* is similar to FIG. 1 where the tongue shape 55*a* fits between the lips 42*c* of the C channels 42 and abuts the web 42*a* when installed in place. In FIG. 6 the projection 55*p* with the extension 55*e* extends past the web 42*a* and is longer than the flange 42*b* of the C channel 42. The additional length of the projection 55*p* is shown as an extension 55*e* of the foam spacer 55 is the equal to the length of the flange 42*b* plus the length of the indentation 55*i* where the foam spacer 55 abuts is longer than the flange 42*b* of the C channel 42 thereby overlapping the adjacent foam spacer 55. What is shown in FIG. 6 is that the foam spacer 55 can be cut into any configuration and still be installed next to an adjacent C channel 42 using the same configured foam spacer 55. The support member in the structural insulating core can be formed with wood framing 68 or the C channel 42 as shown in FIGS. 21-24, however the tongue space 55*a* is not required in the foam spacer 55 and the horizontal bracing channel shown as a horiztonal U channel 155 is not required. Inner and outer boards as shown in FIG. 1 can be installed over the structural insulating core to form a structural insulated panel (SIP). In addition, a cementitious coating 195 (not shown) can be installed on any of the foam spacers 55 prior to being installed in the C channels 42.

Figure 7:
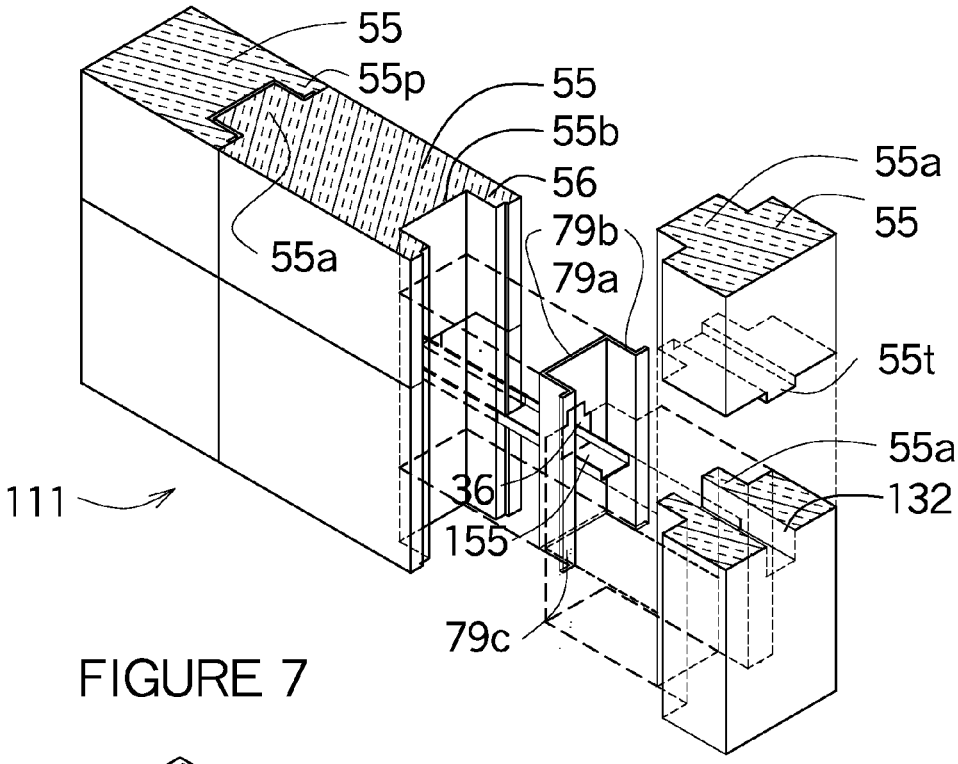
FIG. 7 shows an isometric view of FIG. 2 using the reverse lip channel as the support channel.

FIG. 7 shows an isometric view of the plan view shown in FIG. 2. The projections 55*p* are extended from the groove side 56*b* of the foam spacer 55. The projections 55*p* abut the lips 79*c* of the reverse lip channel 79. The reverse lip channel 79 is shaped similar to the C channels 42 which are commonly used in the building industry. The reverse lip channel has a web 79*a* with flanges 79*b* bent at 90 degrees to the web 79*a* and two lips 79*c* that are bent 90 degrees from the flanges 79*b*, but are bent away from the web 79*a*. The web 79*a* has holes 36 that are aligned between reverse lip channels 79 so horizontal bracing channels shown as a horizontal U channels 155 can pass through. FIG. 7 as shows the trough 132 at the top of the foam spacer 55 so the horizontal U channel 155 can secure the foam spacers 55 to the support channels.

Figure 8:
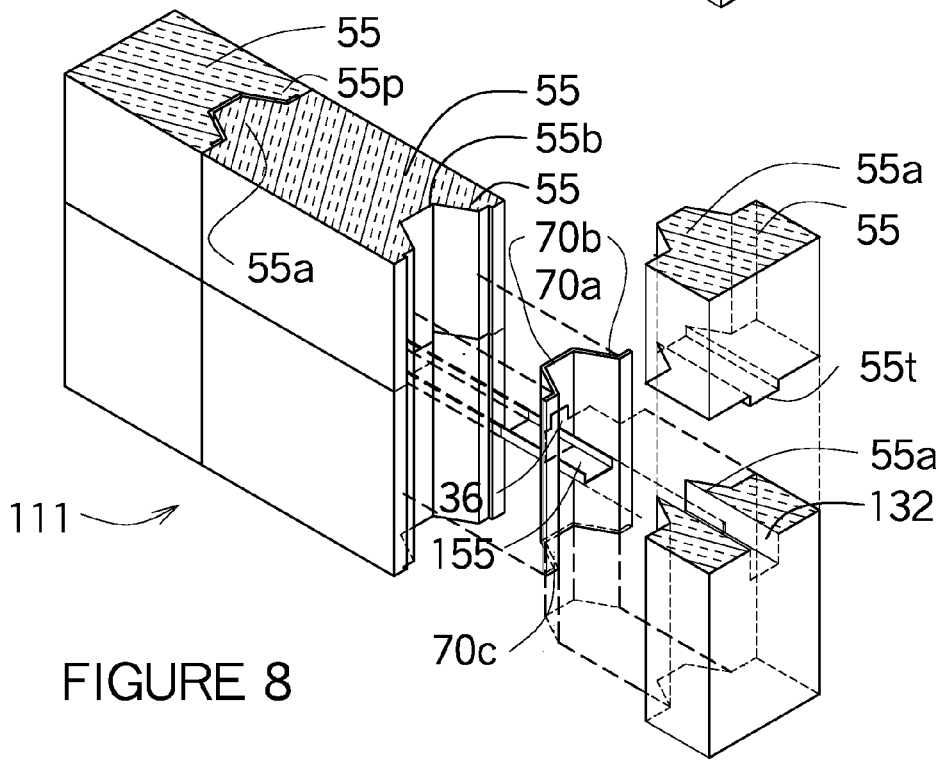
FIG. 8 shows an isometric view of a hat channel as the support channel which is similar to FIG. 7.

FIG. 8 shows an isometric view of a hat channel 70 used as a support channel between foam spacers 55. Since the hat channel 70 has angular flanges shown as 70*b* there is no means to make a secured connection to a base plate 121 as shown in FIG. 1 to the flange 70*b* of the hat channel 70. The hat channel 70 with the horizontal bracing channel shown as horizontal U channels 155 makes a vertical and horizontal connection between foam spacers 55, as shown and explained in FIG. 12.

Figure 9:
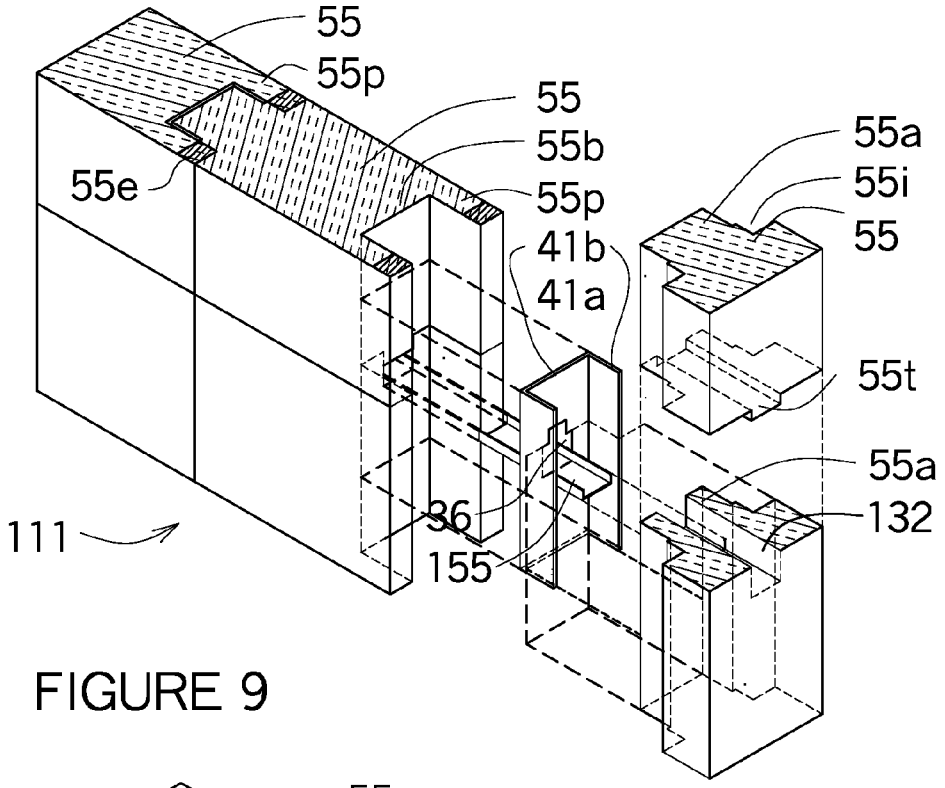
FIG. 9 shows an isometric view of the U channel as the support channel and the projection and extension of the foam spacer overlapping the flange.

FIG. 9 is an isometric view of the structural insulation core 111 where U channels 41 are the support channels rather than the C channels 42 shown in FIG. 1. The foam spacers 55 are shown with the groove side 55*b* abuts the web 41*a* and the projections 55*p* fits against the flanges 41*b* and the extension 55*e* rests against the indentation 55*i* of the tongue side 55*a* of the adjacent foam spacer 55. The horizontal bracing channel shown as a horizontal U channel 155 passes through the holes 36 of the U channel 41 and into the trough 132 of the foam spacers 55. The horizontal tongue 55*t* on the foam spacers 55 fit into the trough 132 interlocking the projections 55*p* with their extensions 55*e*, the U channel, and the trough 132 and tongue 55*t* together.

Figure 10:
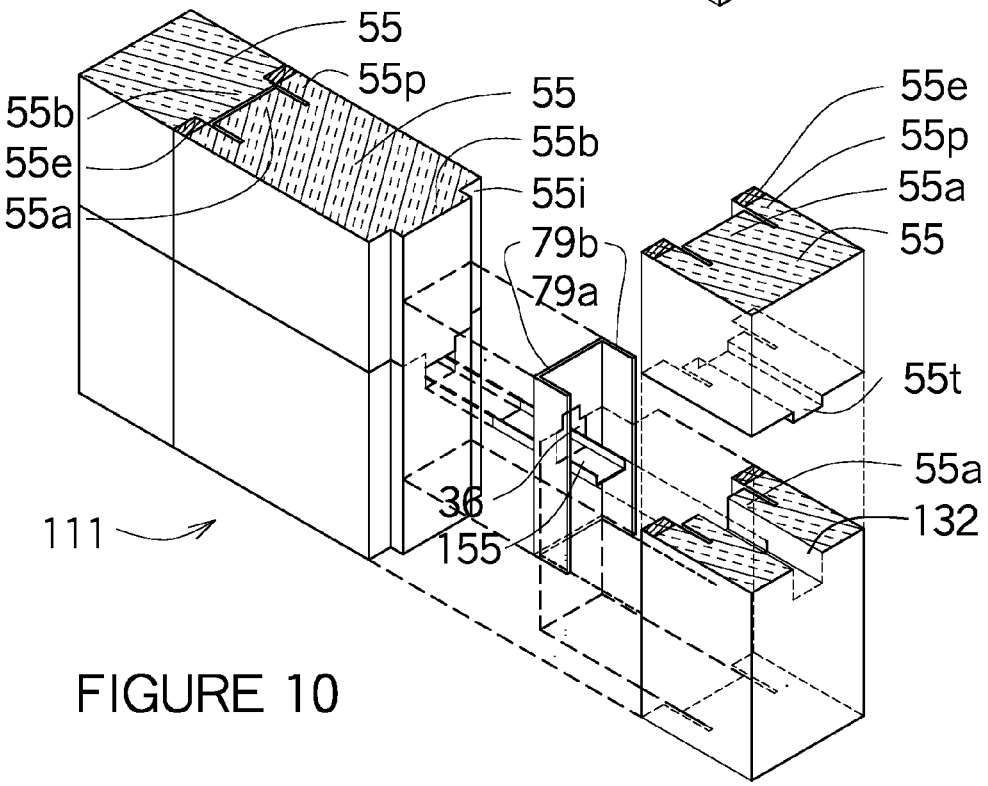
FIG. 10 shows an isometric view of the U channel as the support channel where the projection and extension of the foam spacer and the tongue side of the foam spacer are on the same side.

FIG. 10 shows an isometric view of a structural insulating core 111 with an alternated shape for the foam spacer 55 as shown in FIG. 6 except a U channel 41 is used as the support channel. The foam spacer 55 shows the tongue shape 55*a* with the projection 55*p* and extension 55*e* on the same side of the foam spacer 55. The projection 55*p* with the extension 55*e* extends past the web 41*a* and is longer than the flange 41*b* of the U channel 41. The additional length of the projection 55*p* is shown as an extension 55*e* of the foam spacer 55 is the equal to the length of the flange 41*b* plus the length of the indentation 55*i* on the groove side 55*b* where the foam spacer 55 abuts is longer than the flange 41*b* of the U channel 41 thereby overlapping the adjacent foam spacer 55.

Figure 11:
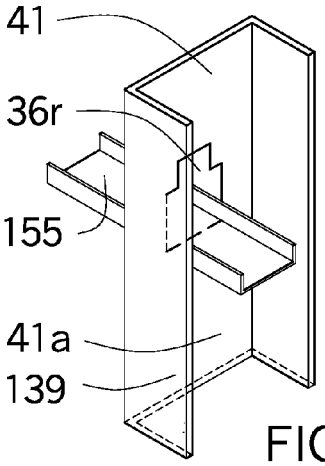
FIG. 11 shows an isometric of the bracket and horizontal bracing channel connected.
Figure 12:
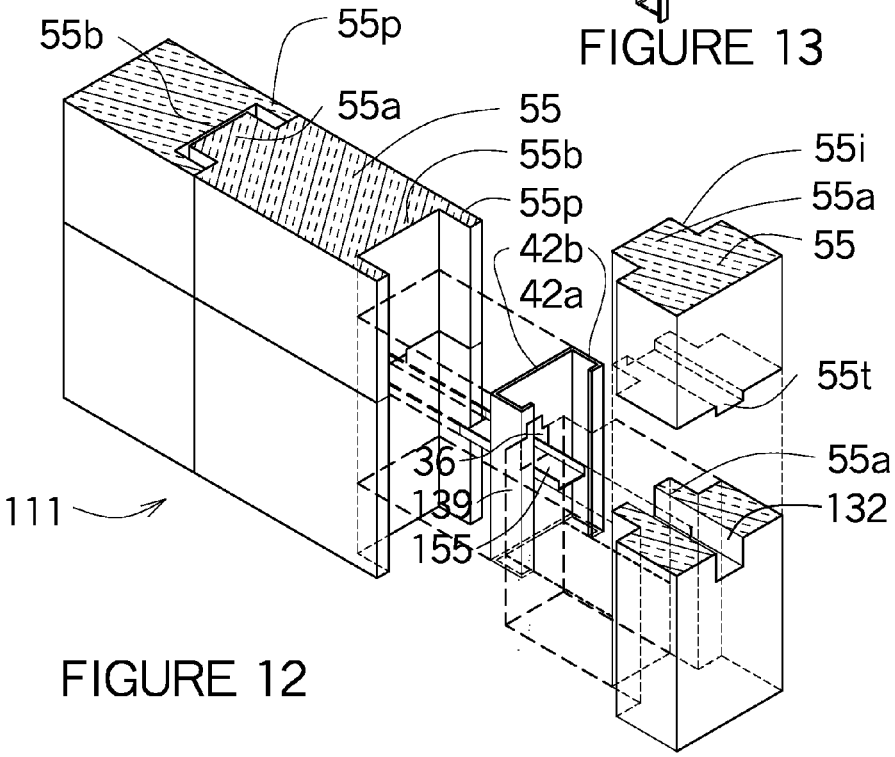
FIG. 12 shows an isometric with the bracket and foam spacer together.
Figure 16:
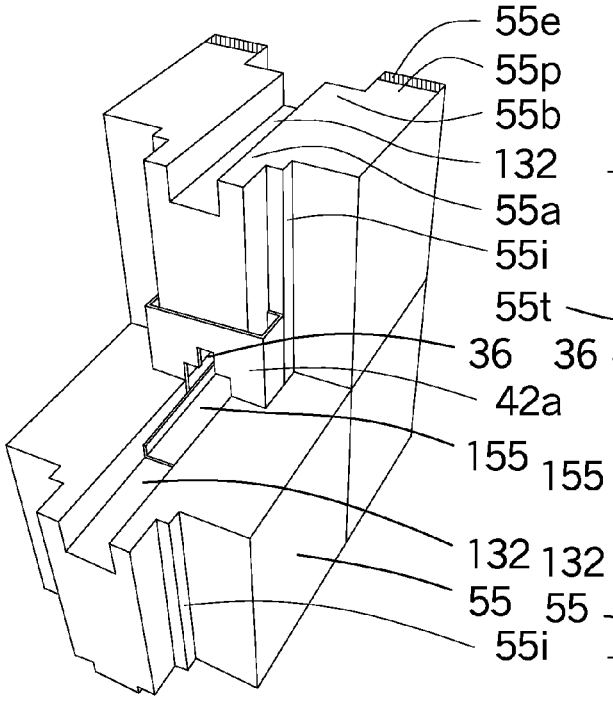
FIG. 16 shows a perspective view of 3 foam spacers being secured when the foam spacers overlap the flange at the tongue side of the foam spacers.
Figure 17:
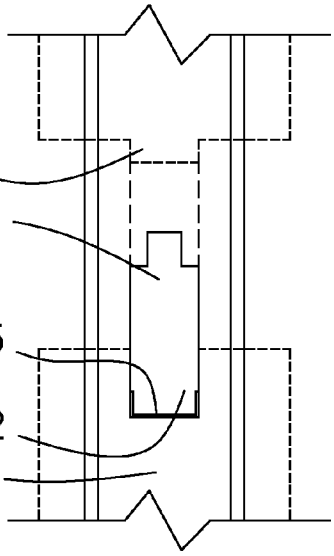
FIG. 17 shows a wall section of FIG. 15.

FIG. 11 is an isometric of a bracket that consists of a short support channel and a short horizontal bracing channel passing through the hole in the web of the support channel. The bracket is shown as a U channel 41 with a hole 36 in the web 41*a* where the horizontal bracing channel shown as a horizontal U channel 155 is secured at the hole 36. The bracket 138 can be of one piece where the horizontal bracing channel 155 is a solid connection at the hole 36 or two separate pieces. FIG. 12 shows the bracket 138 and the horizontal U channel 155 connects adjacent foam spacers 55 as shown in FIGS. 13-16. When the bracket 138 is used as two separate components, the support channel shown as U channel 41 is short that is only extending to the top two and bottom two spacer blocks 36 and the horizontal U channel 155 connects to many brackets 138 within the length of the building wall. When this occurs, the support channels as shown in FIG S. 11-12 & 14-17 are not structural supports for the structural insulating core 111. The spacer blocks 36 are made of a load bearing blocks and the brackets 138 are used as a mortarless joint construction or dry stacking the foam spacers 55 together. FIG. 14 shows an isometric view and FIG. 15 a wall section of the bracket 138 with the foam spacers 55 shown with the projections 55*p* and extensions 55*e* located on the tongue side 55*a* of the foam spacers 55. FIG. 16 shows an isometric view and FIG. 17 a wall section of the bracket 138 with the foam spacers 55 shown with the projections 55*p* and extension 55*e* located on the groove side 56*b* of the foam spacers 55.

Figure 13:
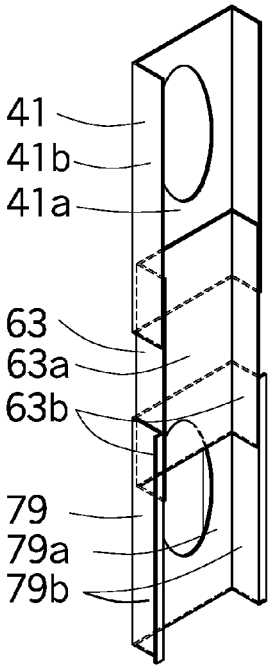
FIG. 13 shows an isometric of two channels connected by a coupling.
Figure 14:
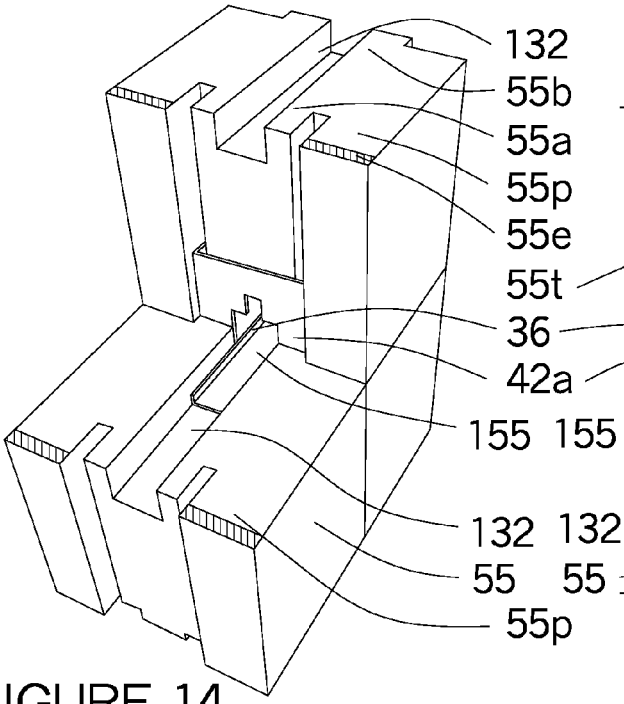
FIG. 14 shows a perspective view of 3 foam spacers where the foam spacers have the projection and extension on the same side as tongue side.

FIG. 13 shows and isometric view of reverse lip channel 79 with a coupling 63 between the U channels 41 connecting both of the channels together. The coupling 63 can be used to connect any support channels together that have flanges perpendicular to the web. The coupling 63 is shown connecting to the webs 79*a* & 41*a*, as well as the flanges 79*b* & 41*b* to the flanges 63*b* and web 63*a* of the coupling 63. The coupling 63 can be connected to the inner surface or outer surface of the reverse lip channel 79 and U channel 41.

Figure 18:
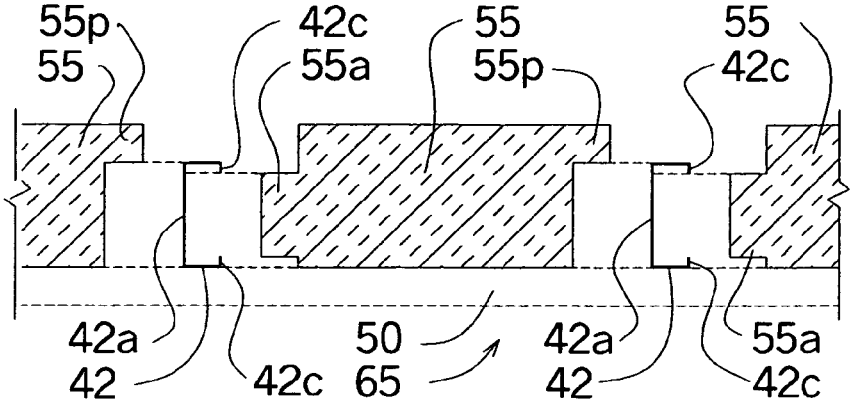
FIG. 18 show a roof section of the foam spacers where the foam spacers extend to the flange of the roof support channel.
Figure 19:
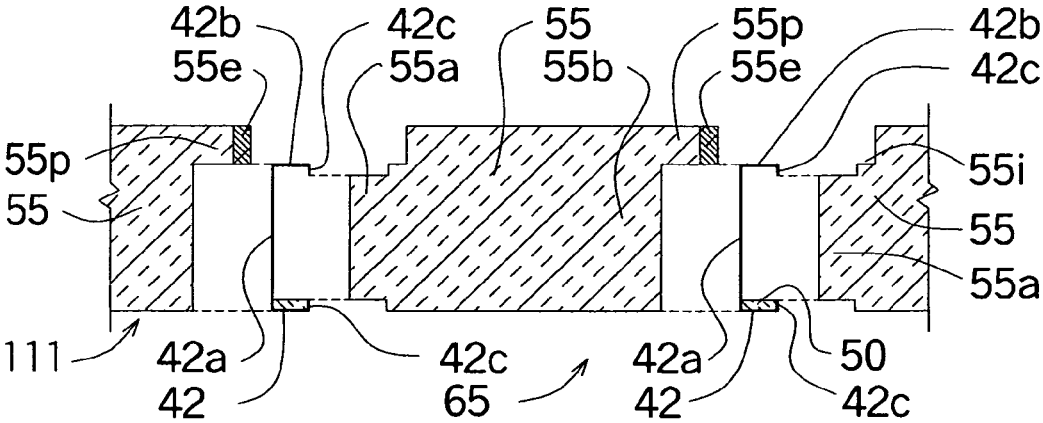
FIG. 19 shows the roof section of the foam spacers having an extension added to the projection of the foam spacers.
Figure 20:
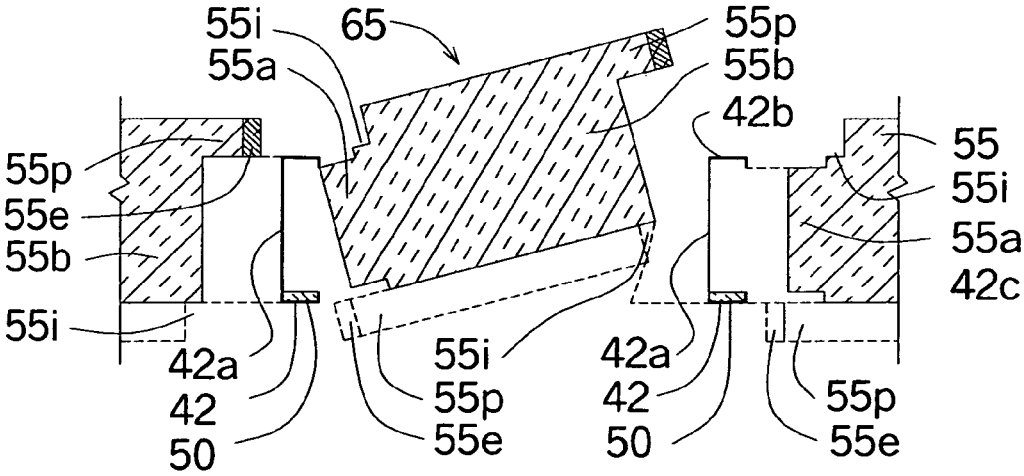
FIG. 20 shows the foam spacers at the roof sliding together.

FIGS. 18-20 shows various roof sections which are similar to the wall sections of the structural insulating core 111 described earlier. The support channels for a roof are typically deeper as shown in the C channel 42 as well as the depth of the foam spacers 55 than a building wall. The profile of the foam spacers 55 in FIG. 18 is similar to the profile at the plan view shown in FIG. 4 except the C channels 42 are shown deeper and the foam spacer 55 is thicker. In FIG. 18 the foam spacers 55 can have a rigid boards 50 added to the bottom of the wall panel or can be one piece where the rigid board 50 is part of the spacer block. One side of the foam spacers 55 fits against the webs 42*a* and against the lips 42*c* of the C channel 42. If the support channel was a U channel 41 (not shown) then the spacer block would rest directly on the flange 41*b*. The other side of the foam spacers 55 rests against the web 42*a* of the adjacent C channel 42 and the projection 55*p* rests on the upper flange 42*b*. In FIG. 19 the projection 55*p* and extension 55*e* is longer, similar to FIG. 4, and the extension 55*e* rests on the indentation 55*i* of the adjacent foam spacer 55. The projection 55*p* and extension 55*e* overlapping onto the indentation 55*i* forms a greater thermal break in the foam spacer 55 as compared to FIG. 17. FIG. 20 is the same profiles as the spacer blocks in FIG. 19, however foam spacer 55 has an increased thickness (shown in ghost) with another projection 55*p* and extension 55*e* added on the same side as the lip 42*c* and flange 42*b* of the C channel 42. Again the adjacent foam spacer 55 has the indentation 55*i* to accept the extension 55*e* of the foam spacer 55 shown at an angle. The groove side 55*b* shows a projection 55*p* with the extension 55*e* is shown overlapping the flange 42*b* on top of the C channel 42 and the tongue side 55*a* of the foam spacer 55 shows the projection 55*p* with the extension 55*e* extending under the flange 42*b* of the adjacent C channel 42. The lower extension 55*e* adds support to the foam spacer 55. By having the projection 55*p* below the support channel, the connection between C channels is less obstructive than having both projections 55*p* on the same tongue side 55*a* or the same groove side 55*b*. The roof section in FIG. 20 can also be used as a plan view of any of the previous described wall constructions.

Figure 15:
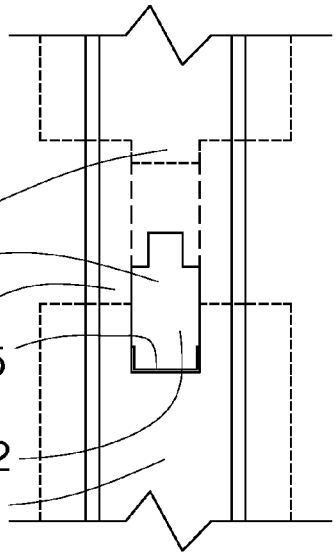
FIG. 15 shows a wall section of FIG. 13.
Figure 21:
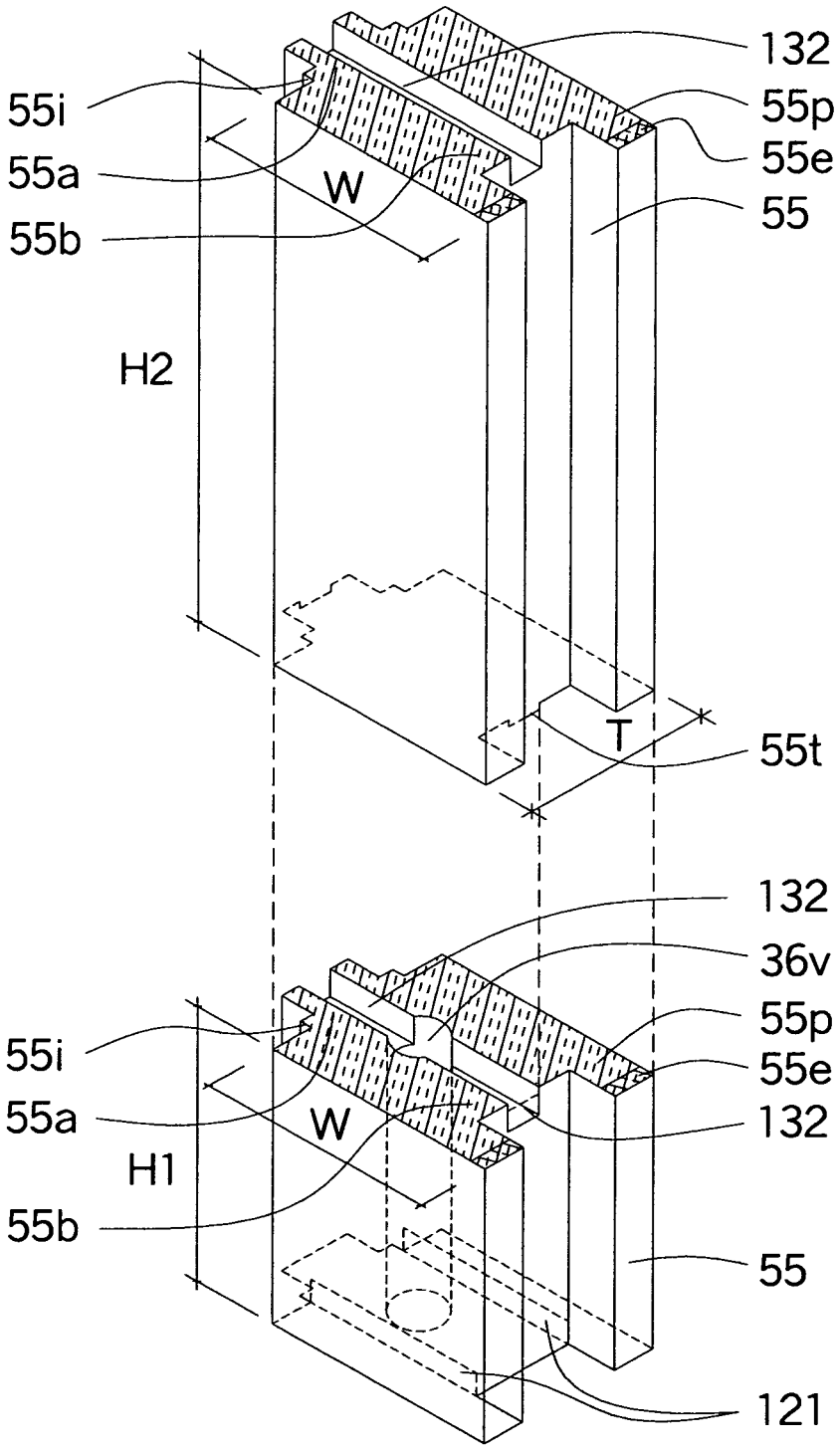
FIG. 21 shows an isometric of one profile of the foam spacer with a smaller foam spacer below.

FIG. 21 shows two foam spacers 55 without the C channel 42 as shown in FIG. 15. The foam spacer 55 consists of a width W, the spacing distance between support channels; a height H shown as h1 and h2, the height of the foam spacers which will vary depending on the height of the wall; and thickness T, the thickness of a wall or thickness of the foam spacer 55. The thickness T of the foam spacer 55 is greater than the depth of the support channel to allow for projections 55*p* extend over the flanges 42*b* on both sides of a support channel. The vertical connection between foam spacers 55 is a tongue and groove connection described earlier as a tongue side 55*a* that fits into and between the U shape created by the web 42*a* and flanges 42*b* and abuts the lips 42*c* of the C channel 42 as shown in FIG. 15. The opposite side of the foam spacer 55 is shown with the groove side 55*b* which abuts the web 42*a* of the C channel 42 and has projections 55*p* that extend over both flanges 42*b*. FIG. 20 shows extensions 55*e* that allow the projection 55*p* with its extension 55*e* to overlap onto an adjacent foam spacer 55. The overlap is shown on the tongue side 55*a* where an indentation 55*i* is shown to accept the extension 55*e* from an adjacent foam spacer 55. FIG. 1 shows the same foam spacer as described here, but without the extension 55*e* added to the projection 55*p*. The horizontal connection between foam spacers 55 is also a tongue and groove connection described earlier as a trough 132 which is a groove that is shown as a rectilinear shape, but can be any shape so the horizontal tongue 55*t* can from an adjacent foam spacer 55 can fit into the trough 132. The trough 132 is deeper than the tongue 132 to allow any horizontal mechanical passage between support channels and foam spacers 55. The lower foam spacer 55 shows a vertical hole 36*v* passing through the trough 132 and/or the horizontal tongue 55*t* (not shown) if need be. The foam spacers 55 can be stacked vertically together and grooves 121 (shown as a single dashed line) can be installed on the top or bottom of the foam spacers 55 to form a wall. The foam spacers 55 can be made from a variety of closed cell materials that resist heat transfer like polystyrene, aerated autoclave concrete, concrete with polystyrene beads and cellular lightweight concrete. The foam spacers 55 can be installed with or without fasteners as well as with or with mortar. The foam spacer 55 profile would typically be cut by a hot wire machine for polystyrene; however the foam spacer 55 profile can also be molded.

Figure 22:
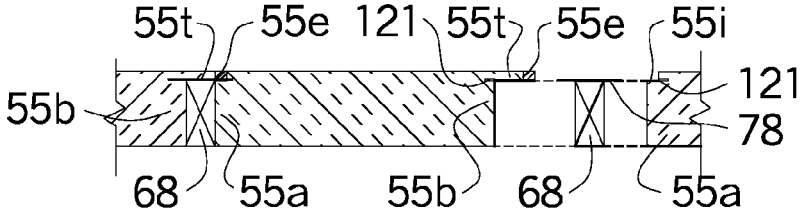
FIG. 22 shows a wall plan view of the projection and extension of the foam spacer extending over one side of the wood framing member.
Figure 23:
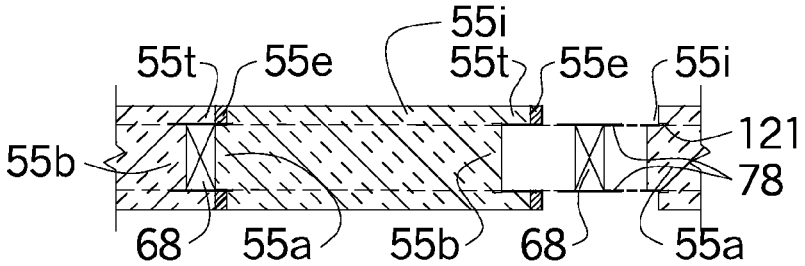
FIG. 23 shows a wall plan view of the projection and extensions of the foam spacer extending over both sides of the wood framing member.
Figures 24, 25:
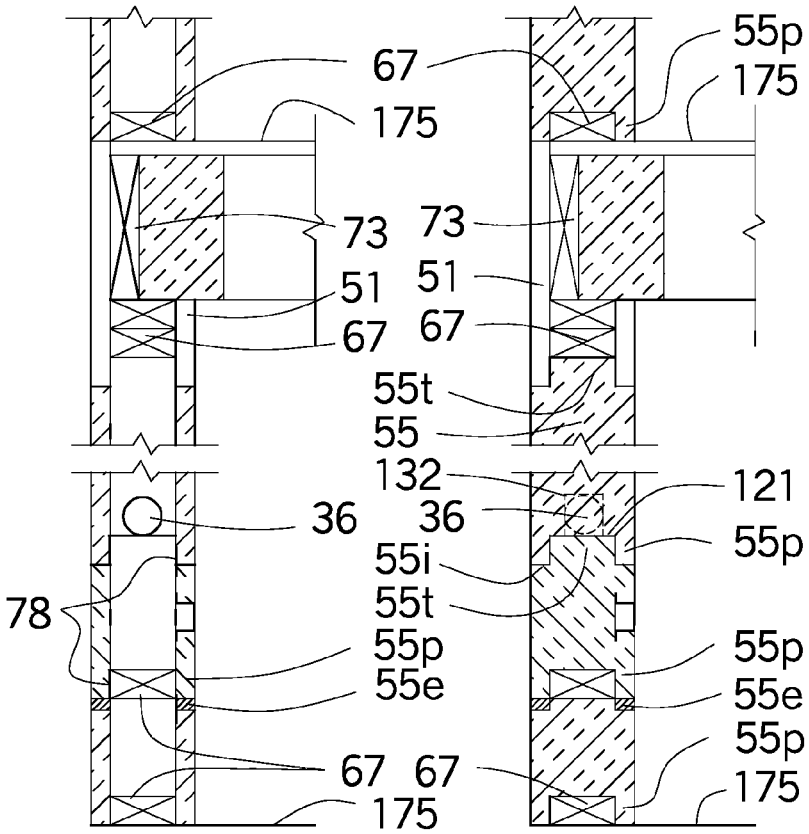
FIG. 24 shows a wall section at the wood framing member
FIG. 25 shows the wall section at the foam spacer interlocking between each other.

FIGS. 22-25 shows the foam spacer 55 installed between a wood framing system consisting of wood framing members 68 spaced apart from one another and wood plates 67 connecting the wood framing members 68 together which is standard wood framing construction techniques. Between the wood framing members 68, foam spacers 55 are shown with a tongue side 55*a* and a groove side 55*b* and is wider than the depth of the wood framing members 68. The tongue side 55*a* abuts the wood framing member 68 and extends past the wood framing member 68 so an indentation 55*i* and a projection 55*p* with an extension 55*e* can be installed as shown in FIG. 23. The tongue side 55*a* has indentations 55*i* on both sides of the foam spacer 55. The groove side 55*b* also abuts the wood framing member 68 and has projections 55*p* extend to the opposite side of the wood framing member 68 and an extension 55*e* is added to the end of the projection 55*p* so the projection 55*p* and extension 55*e* become one element as shown in numerous earlier figures forming a vertical connection between foam spacers. The horizontal connection between foam spacers 55 also has a tongue and groove connection as shown in FIG. 24. The foam spacer 55 in FIG. 25 shows a projection 55*p* extending over both sides of the wood plate 67 at the floor 175. The upper portion of the foam spacer 55 shows a horizontal tongue 55*t* extending above the foam spacer 55 the width of the wood framing members 68 which creates an indentation 55*i* at the top of the foam spacer 55. The bottom of the foam spacer 55 and the foam spacer 55 above shows a horizontal projection 55*p* that fits into the indentation 55*i* of the foam spacer 55 and the horizontal tongue 55*t* is fitting into the trough 132 in the above foam spacer 55. A horizontal brace 78 can be continuous or installed as shorter segments to connect wood framing members 68 together. The horizontal brace 78 is shown installed between the horizontal projections 55*p* and the indentation 55*i* and can also be installed into the grooves 121 at the projections 55*p* and indentations 55*i*. Above the projection 55*p* shown dotted is another trough 132 that is used to distribute mechanical systems (electric or plumbing lines) if a hole 36 (dashed) is installed in the framing member. Another horizontal connection is shown when a wood plate 67 is installed in the middle of the wall (required by some building code officials). When the horizontal connection between the framing members is required, an extension 55*e* is used to maintain the tongue and groove connection. FIG. 22 is similar to FIG. 23 in that only one projection 55*p* is used and the thickness of the foam spacers 55 is narrower.

Figures 26, 27:
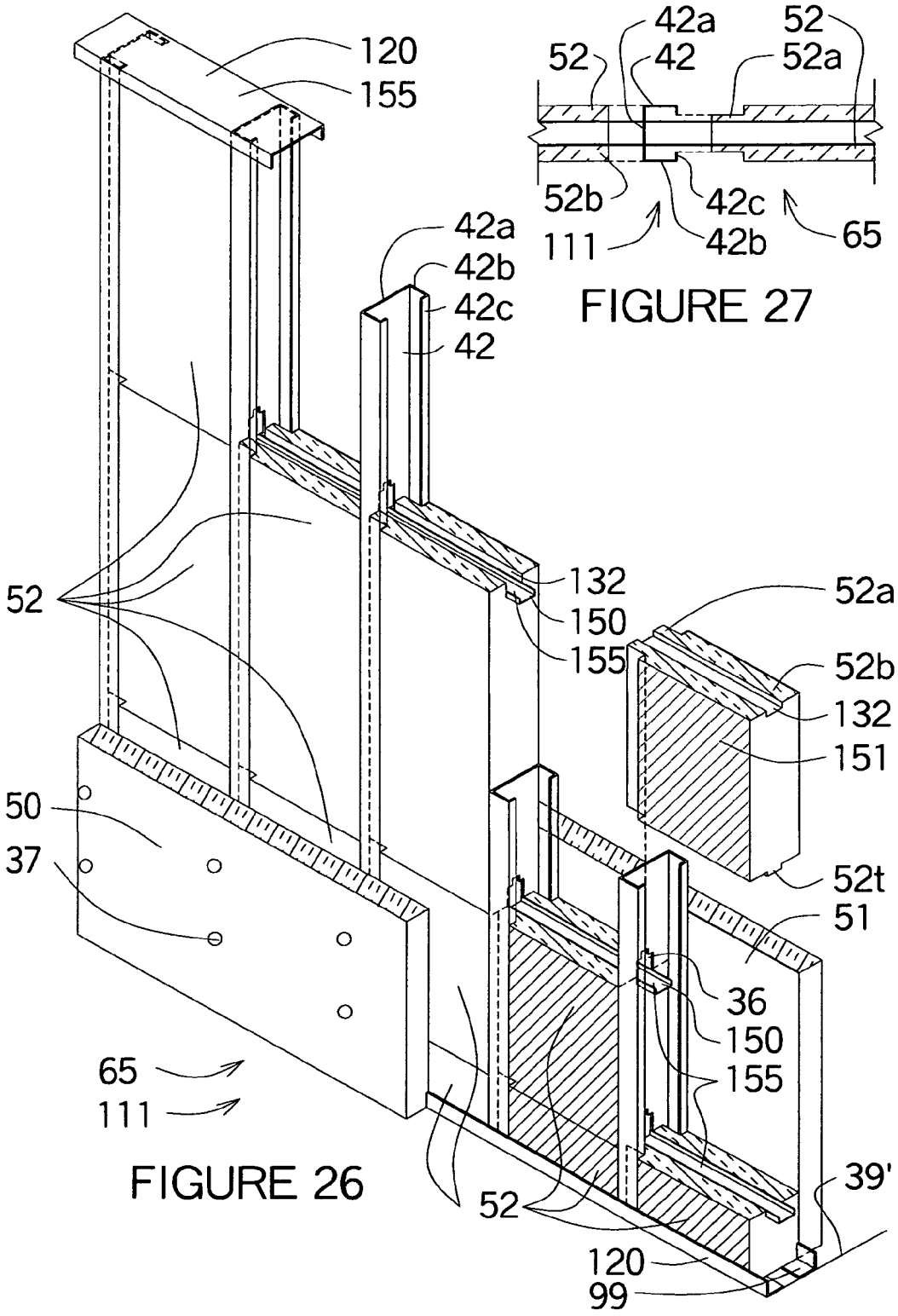
FIG. 26 shows an isometric view of a full height wall where the foam spacers are the width of the support channels.
FIG. 27 shows a plan view of the full height wall

FIG. 26 shows an isometric view of the structural insulating core 111 where the depth of the spacer insulation 52 are the same as the width of the structure channels shown as C channels 42. The inner and outer boards shown on rigid board 50 and rigid insulation 51 can be part of the structural insulating core 111 or be added after the wall is erected into a vertical position. The left side of the spacer insulation 52 is referred to as the tongue side 52*a* where the spacer insulation 52 is installed between the lip 42*c* the depth of the flange 42*b* and abuts the web 42*a* of the C channel 42 and the opposite side or groove side of the groove side 52*b* abuts the web 42*a* of an adjacent C channel 42. Since not all spacer insulation 52 may want to extend the full height of the structural insulating core 111, the spacer insulation 52 abut between each other by connecting together the horizontal tongue 52*t* of one spacer insulation 52 fits into a trough 132 of another spacer insulation 52. The trough 132 can be the depth of the horizontal tongue 52*t* or can be extended deeper to allow of mechanical/utilities to pass through the trough 132 which is larger in size. The horizontal tongue 52*t* and the trough 132 align when the hole 36 of the web 42*a* and the horizontal bracing channel shown as the horizontal U channel 155 passes into the trough 132 and allows the horizontal U channel 155 to connect the C channels 42 together. On the other hand, if the trough 132 is just deep enough for the horizontal bracing channel, the width of the horizontal tongue 52*t* is narrower so the horizontal tongue 52*t* fits into the horizontal U channel 155. The foam spacer with the tongue and groove connections can have brackets or short support channels and horizontal bracing channels to hold the spacer insulations 52 together. Full height support channels can be used with short horizontal bracing channels to construct a wall as well as short support channels and long horizontal bracing channels connecting many spacer insulations 52 together can also for a wall. The plan view FIG. 28 also shows the intersection of the spacer insulation 52 sliding horizontally between the lips 42*c* connecting the tongue side 52*a* into the C channel 42. The full height wall includes the base plate angles 99 connecting to the concrete floor 39' and the support channels as well as the base plate 120 at the top of the structural insulating core 111.

Figure 28:
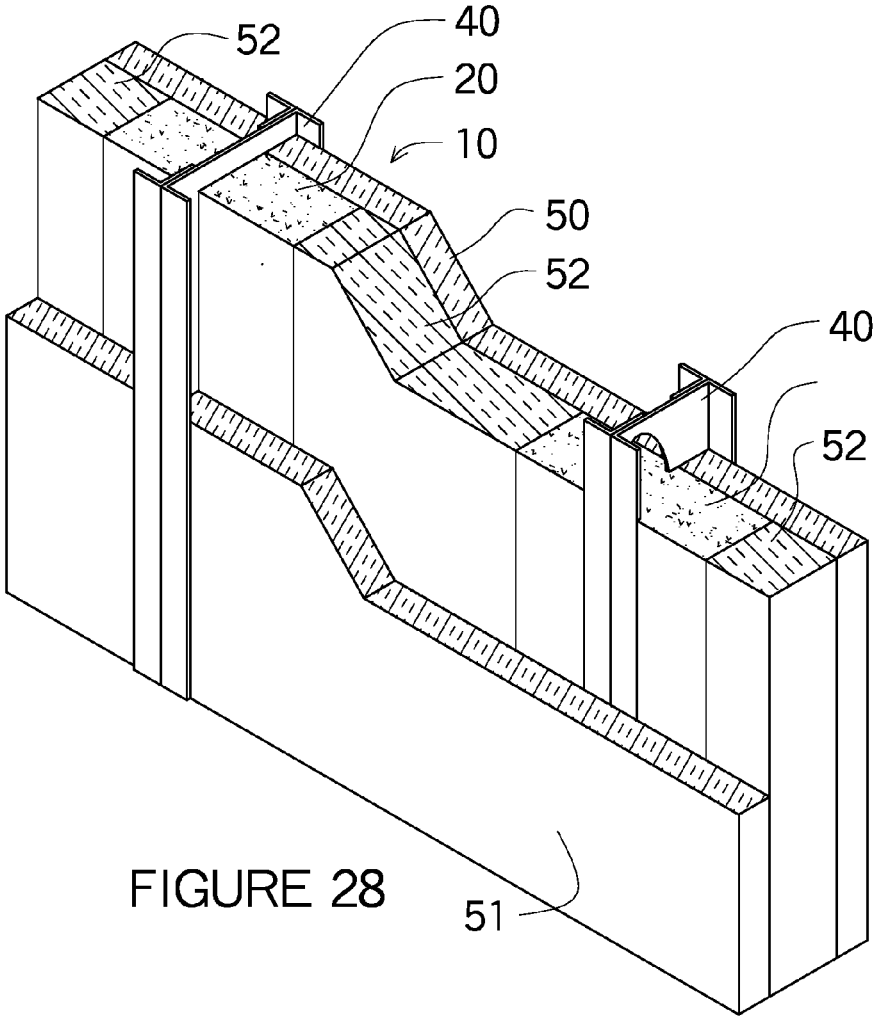
FIG. 28 is an isometric view of a column in a building wall using a wall mold structure in the middle of the column.
Figure 29:
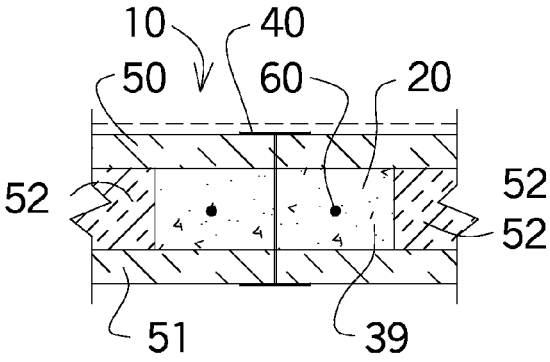
FIG. 29 shows a plan view of a column within the building wall straddling the wall forming mold.
Figure 30:
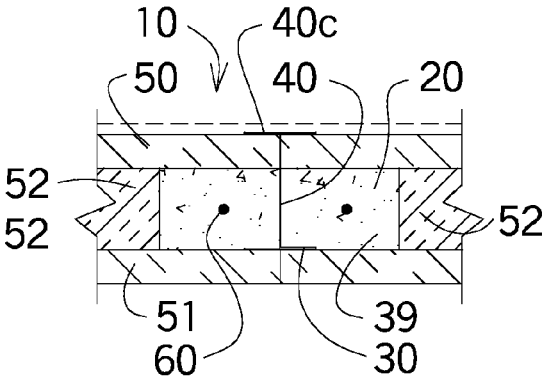
FIG. 30 shows a plan view of a column within the building wall partially embedded with the wall forming mold.

In FIG. 28 a wall mold 10 is shown in isometric view with two different configurations of column molds 20. The wall mold 10 consists of a rigid board 50 and rigid insulation 51 are the inner and outer rigid boards that define the outer surfaces of the wall mold 10. The interior of the column molds 20 & 21 are also shown in a plan view drawing in FIG. 29 and FIG. 30. The width of the column mold 20 are determined by the thickness of the spacer insulation 52 located between the rigid board 50 and the rigid insulation 51. On the other hand, the width of the column molds 20 is the distance between the spacer insulation 52. In FIG. 29 the support channel of the column forming structure is an H channel 40 shown at the middle of the column mold 20 extending outside of the wall mold 10 but yet an integral part of the column mold 20 securing both the rigid board 50 and the rigid insulation 51 to the wall mold 10. In FIG. 30 the H channel 40 is smaller than in FIG. 29 which allows the rigid insulation 51 to be secured to the outer surface of flange 40*c* of the H channel 40. The opposite flange 40*c'* of H channel 40 is secured on the interior surface of the flange 40*c'* making it easier to fasten another material (shown in ghost) to the H channel 40. Since no fastening means is shown connecting the spacer insulation 52 to either the rigid board 50 and rigid insulation 51, the material has to be compatible so an adhesive (not shown) can connect the various materials together. The depth of the column molds 20 are determined by the structural strength of the adhesive and the bending stress of the rigid board 50 and rigid insulation 51. On the other hand, the rigid board 50, rigid insulation 51 and the spacer insulation 52 could all be formed of the same material and secured together with the H channel 40. Steel reinforcing 60 can be added prior to the column molds 20 being filled with a hardenable material.

Figure 31:
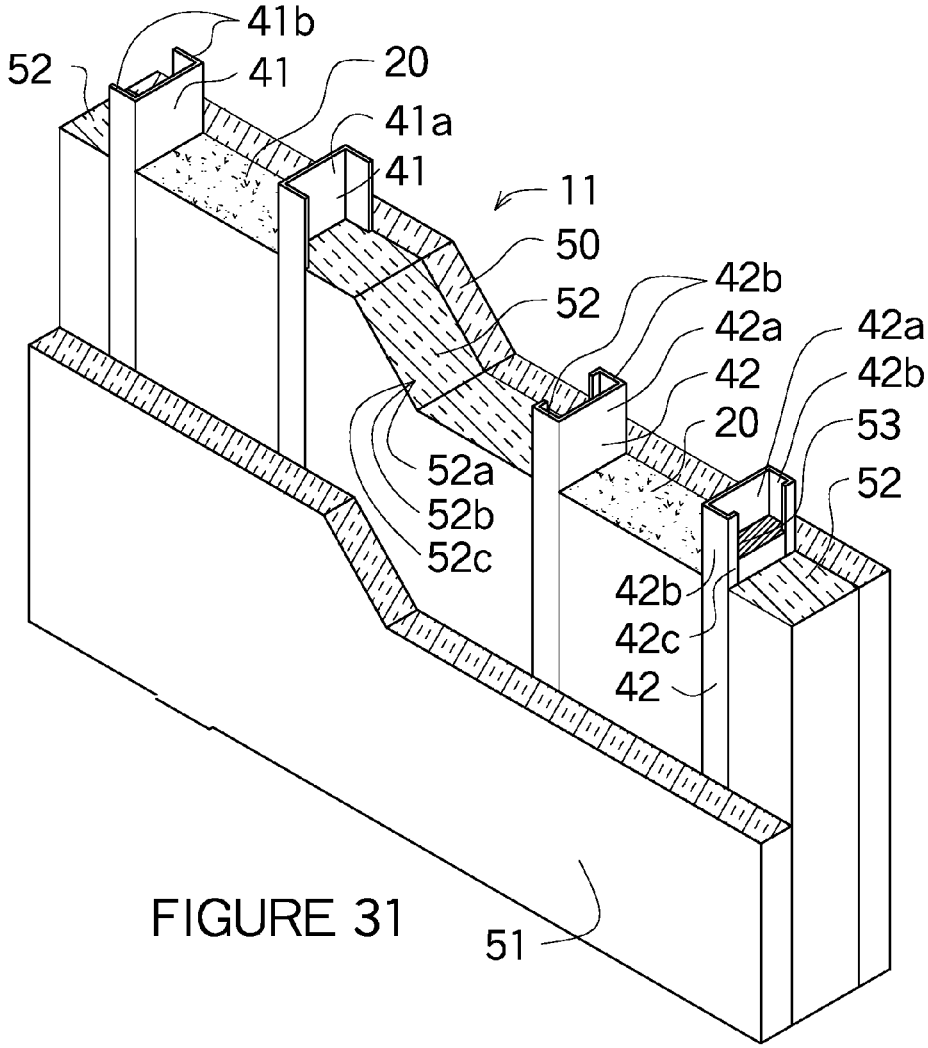
FIG. 31 is an isometric view of a wall column using two U or C channels to help support the column mold.
Figure 32:
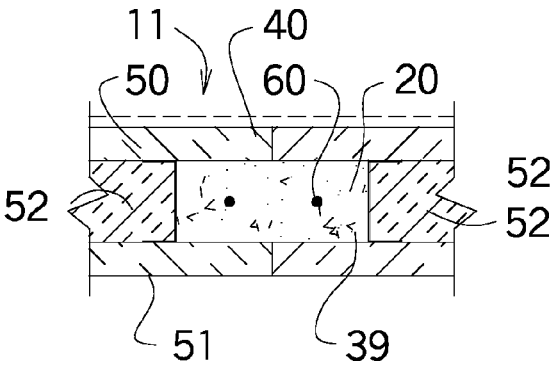
FIG. 32 is a plan view showing the U channels supporting the wall mold.
Figure 33:
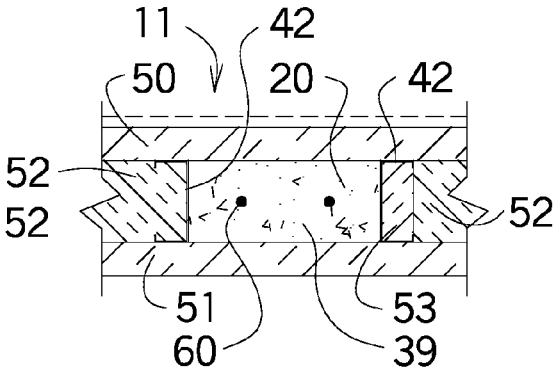
FIG. 33 is a plan view showing the C channels supporting the wall mold.

In FIGS. 31-33 a wall mold 11 is shown in isometric view with two column molds 20. The wall mold 11 consists of a rigid board 50 and rigid insulation 51 as the outer surfaces of wall mold 11 along with the spacer insulation 52 between the outer surfaces. The column forming structure within the column mold 20 shown in FIGS. 31 & 32 consists of two support channels shown as U channels 41. The flanges 41*b* are secured to the rigid board 50 and the rigid insulation 51 along with the spacer insulation 52. The spacer insulation 52 fits securely between the web 41*a* of each U channel 41. The space between the web 41*a* of the U channel 41 define the depth of the column mold 20. In FIG. 33 the column mold 20 uses support channels shown as C channels 42 to function in a similar capacity as the U channels 41 in FIG. 32. The C channels 42 in FIG. 33 have a lip 42*c* to give the column mold 20 additional strength. As like FIG. 32 the web 42*a* the C channels 42 define the width of the column mold 20. The C channel 42 is shown with rigid foam 53 at the interior of the C channel 42. The rigid foam 53 is secured within the C channel 42 by the two flanges 42*b* and the web 42*a* and the lip 42*c*. The rigid foam 53 eliminates any air infiltration that could occur within the C channel 42. Since the wall mold 11 has the U channels 41 or the C channels 42 as part of the column mold 20, the spacer insulation 52 can be installed as part of the wall mold 11 or the spacer insulation 52 can be installed after the wall mold 11 has been installed in a vertical position. When the spacer insulation 52 is a solid material the spacer insulation 52 can be fabricated as part of the wall mold 11 and prior to erecting the wall mold 11. On the other hand if the spacer insulation 52 is not installed prior to the wall mold 11 being erected, a loose granular insulation material 52*a* can be poured into the area occupied by the spacer insulation 52 through the top of the wall mold 11. In addition, in lieu of a loose granular insulation 52*a*, a dry cellulose fiber insulation 52*b* or a liquid foam 52*c* can also be filled from the top of the wall mold 11. Typically the spacer insulation 52 is a rigid foam type material, however new products are being developed like hybrid natural-fiber composite panel with cellular skeleton tubular openings which can function the same as a rigid foam material.

Figure 34:
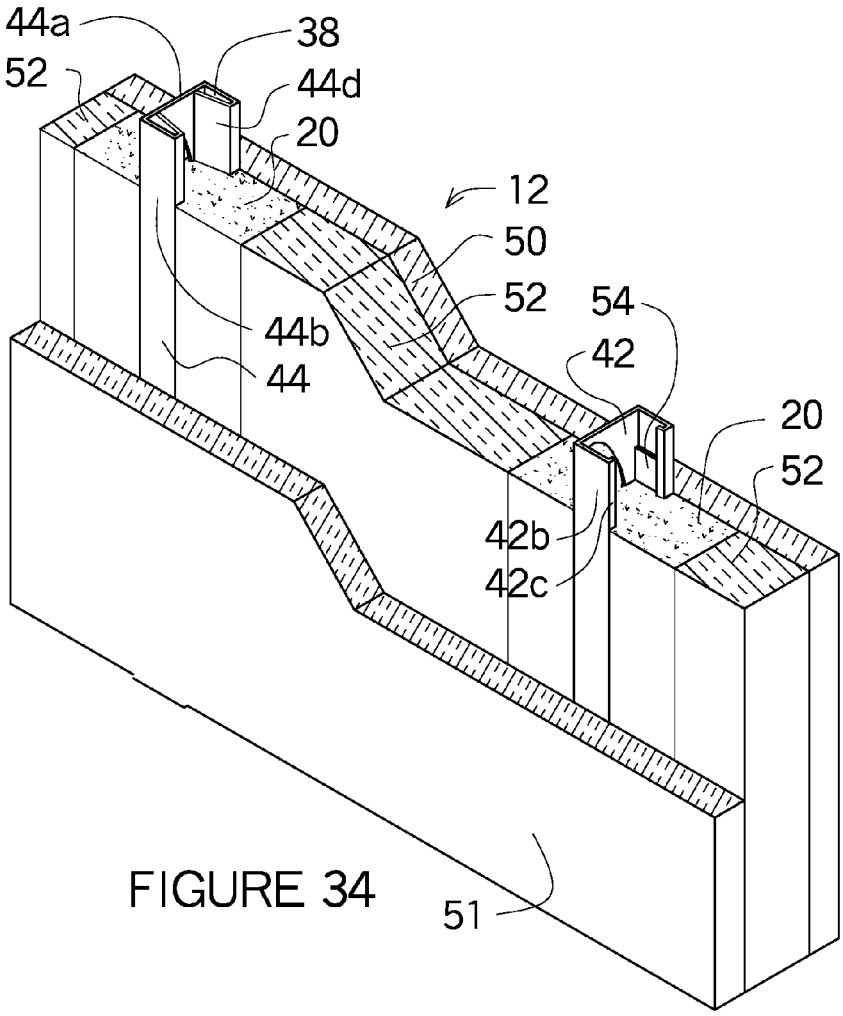
FIG. 34 is an isometric view of two columns one using a bent flange channel at the support channel of the column mold and the other column a C channel.
Figure 35:
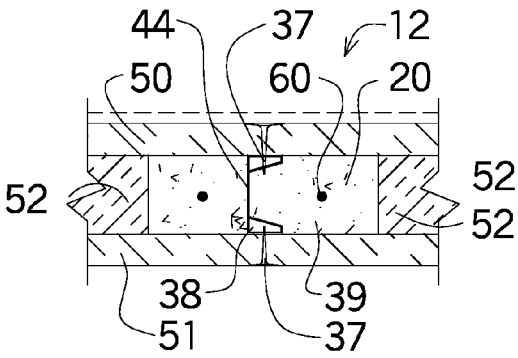
FIG. 35 is a plan view showing the bent flange channel at the center of the column forming structure.
Figure 36:
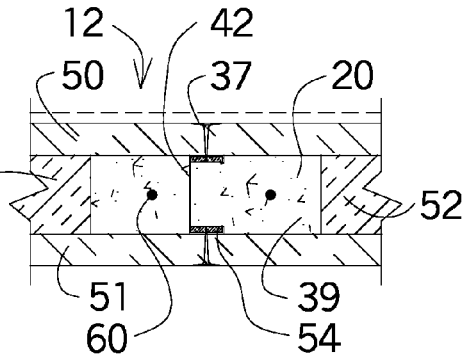
FIG. 36 is a plan view showing a C channels with insulation material at the flange.

In FIGS. 34-36 a wall mold 12 is shown in isometric view with two column molds 20. The wall mold 12 consists of a rigid board 50 and rigid insulation 51 as the outer surfaces of wall mold 12 along with the spacer insulation 52 between the outer surfaces. The distance between the spacer insulations 52 define the width of column mold 20. The plan view in FIG. 35 shows a bent flange channel 44 as the column forming structure and is located in the middle of column mold 20. The bent flange channel 44 has a web 44*a* which is the same width as the spacer insulation 52. The bent flanges consist of two parts, that is, 44*b* is adjacent to the rigid insulation 51 and the remainder of the bent flange 44*d* is bent again to be close to the web 44*a*. The double bending of flange 44*b* & 44*d* allows a fastener 37 to secure the bent flange channel 44 at two spots that is the flange 44*b* and 44*d*. Light gauge metal say 25 gauge is not very strong, and the double flanges 44*b* and 44*d* allow two surfaces into which a fastener 37 can attach to and thereby increasing the strength a fastener 37 can attached to support the rid board 50 as well as resist the force of wet concrete 39 pushing against the rigid board 50. When the wall mold 12 is erected vertically the steel reinforcing 60 is added and the column mold 20 is filled with concrete 39. Upon doing so the web 44*a* and the bent flanges 44*b* & 44*d* create a cavity 38. Between the lip 42*c* and the web 42*a* and adjacent to the flanges 42*b* a foam material 54 can be installed.

Figure 37:
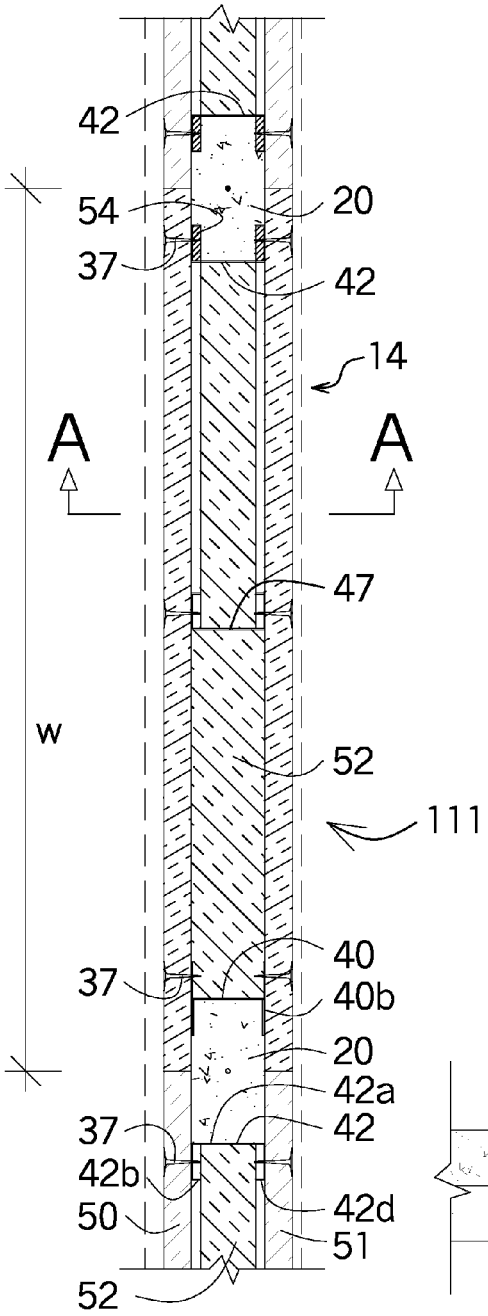
FIG. 37 is a plan view of panel incorporating some of the forming structures previously described.

In FIG. 37 is a plan view of wall mold 14 which consists of three wall panels that is one wall panel is in the middle and two wall panels are located on both sides of the center wall panel. The width of the wall panels are from the centerline of one column mold 20 to the centerline of the other column mold 20 and the desired height of a building wall as shown FIG. 44. The three wall panels all show rigid board 50 and rigid insulation 51 extending to the centerline of one column mold 20 to the centerline of the other column mold 20 as the inner and outer surfaces; however all three columns molds have a slightly different configurations within the wall mold 14. The lower partial wall panel shows one-half of column mold 20 wherein the support channels is shown as C channel 42 and the flange 42*b* is overlapping the spacer insulation 52. By having the flange 42*b* overlap the spacer insulation, additional material like drywall (shown in ghost) can be attached with a fastener 37 to the C channel 42. The spacer insulation 52 is shown as a rigid type insulation that is smaller than the web 42*a* and fits between the lips 42*d* of the C channel 42. The other half of column mold 20 is shown in wall panel where an H channel 40 is used. A portion of the flange 40*b* extends into the spacer insulation 52 which now allows additional material (shown in ghost) to be installed with fasteners 37. The column molds 20 are formed by using the panel configuration at both the ends of wall panel and the ends of the partial wall panels. In other words, one-half of column mold 20 is form by the C channel 42 in wall panel and the other one-half column mold 20 is formed with the C channel 42 of the partial wall panels. The C channels 42 in both the wall panels have their flanges 42*b* facing within the column mold 20 rather than engaging the spacer insulation 52 as shown in the other column mold 20. In the other column mold 20 both the support channels shown as C channels 42 have foam material 54 shown at the interior of the C channel 42 allowing fasteners 37 to be installed within the column mold 20 after the wall panels has been erected in a vertical position. The width of wall panel varies depending on the number of spacer channels 47 installed within the wall mold 14 and are further described in FIG. 44. When the spacer insulation 52 has the spacer channels 47 added a wall panel a structural insulating core 111 is formed between the inner and outer rigid boards or any of the previous wall molds.

Figure 38:
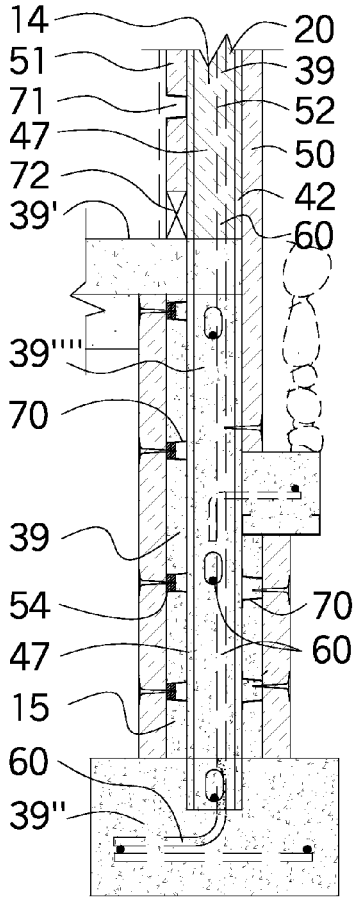
FIG. 38 is a wall section showing how a column forming structure can penetrate into a building footing.
Figure 39:
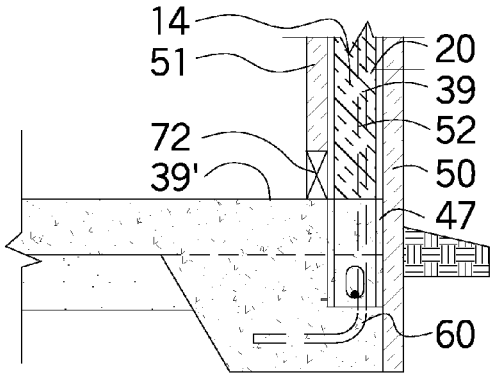
FIG. 39 is a wall section showing the column forming structure is secured within the concrete slab.
Figure 44:
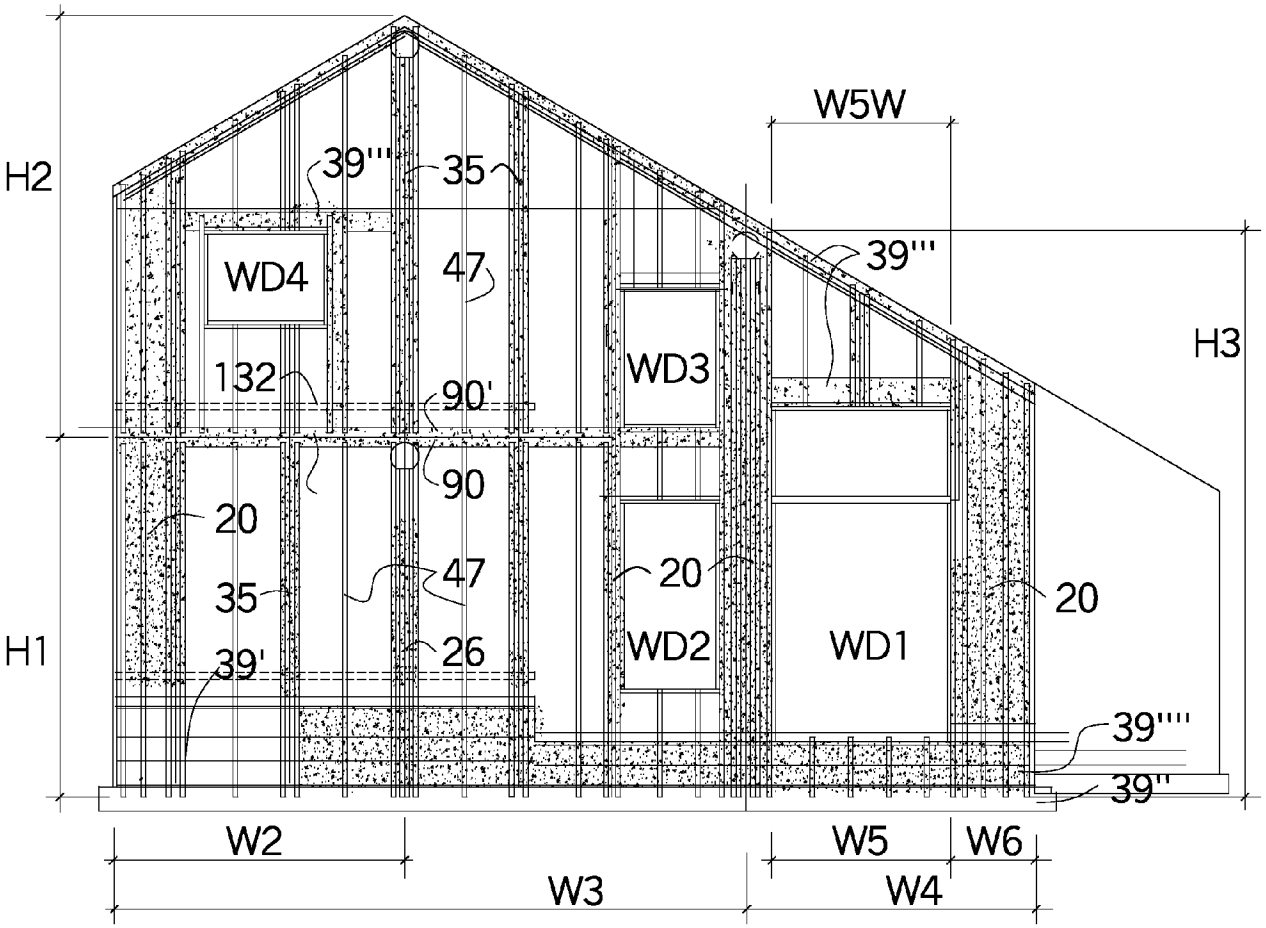
FIG. 44 shows a building elevation with various wall panels comprising of concrete beam and column molds configurations with intermediate spacer channels between the column molds.

In FIG. 38 shows a vertical wall section A-A taken through FIG. 37 however any one of the previously mentioned wall molds could be used or in this case a concrete foundation 39"" is installed below the wall in FIG. 38 and a concrete floor 39' is shown in FIG. 39. The wall sections are taken through the middle of the wall mold rather than at the column molds. The wall panel in FIG. 38 is shown with the spacer channel 47 extending from the concrete footing 39" through the concrete foundation 39"" into the wall mold 14. In FIG. 44 the wall molds are shown as large panels where a foundation can be incorporated into the wall panel. The upper section of the wall molds 14 as shown in FIGS. 38 & 39 are shown with the rigid board 50 and rigid insulation 51 as the outer surfaces along with the spacer insulation 52. If the wall section A-A were taken through the column mold 20 in both FIGS. 38 & 39, concrete 39 would be shown rather than the spacer insulation 52 and reinforcing steel 60 would be installed within the column mold 20. Below the concrete floor 39' is a foundation mold 15 that has hat channels 70 attached to the C channel 42 and a rigid board 50 and rigid insulation 51 are attached to the hat channel 70. The foundation mold 15 is described more fully in US 2007/0044392 by LeBlang. Another hat channel 70 is shown with a foam material 54 attached on the interior side of the hat channel 70. The foam material 54 seals the fastener 37 from any water penetrating through the concrete foundation 39"" as well as from the hat channel 70. The foam material 54 shown on the interior of the hat channel 70 allows additional fasteners (not shown) to be attached to drywall (not shown) to be attached to the concrete foundation 39"". The column mold support shown as the C channel 42 is located within the column mold 20, passes through a foundation mold 15 and then into a concrete footing 39". Therefore the wall panel when installed into a vertical position, will consist of the wall mold 14 plus a foundation mold 15 and the C channel 42, however only the C channel 42 extends through the wall mold 14 and the foundation mold 15 then into the concrete footing 39". The wall mold 14 is also showing a reverse hat channel 71 which is used to secure the rigid insulation 51 or as a horizontal or vertical electrical chase. In addition wood blocking 72 is installed on wall mold 14 for decorative trim base (not shown) can be installed after drywall (shown in ghost) is installed. The wood blocking 72 is also used as a horizontal connection between adjacent wall panels as well as the reverse hat channel 71 and the hat channels 70 used in the foundation mold 15.

FIG. 39 shows the wall panel and the same wall mold as shown in FIG. 37, except here the support channel shown as C channel 42 and spacer channel 47 are longer and extend into a concrete floor 39'. The rigid board 50 is shown extending to the bottom of the concrete floor 39' defining the edge of the concrete floor 39'. As mentioned in FIG. 38 if the wall section A-A where take through the column mold 20 the steel reinforcing 60 would extend from the column mold 20 into the concrete floor 39'.

Figure 40:
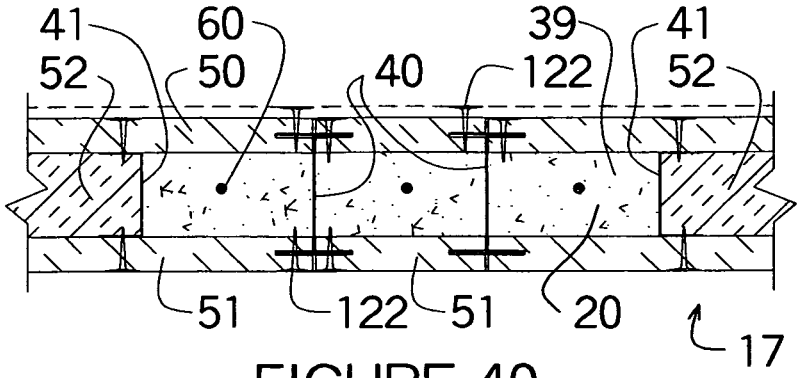
FIG. 40 is a plan view showing and elongated column with the column forming structure embedded within the exterior and interior wall mold structure.

FIG. 40 shows the wall mold 17 consists of a rigid board 50 and rigid insulation 51 as the outer surfaces of column mold 20 and the U channels 41 form the other sides of column mold 20. The flanges 40*b* of the H channel 40 are shown in the middle of the rigid board 50 and rigid insulation 51 as well as between the H channels 40. The rigid board 50 and rigid insulation 51 can each be attached to the H channel 40 by screws 122. Depending on the size of the column mold 20, additional H channels 40 along with additional rigid board 50 and rigid insulation 51' can be installed between the H channels 40 forming a longer column mold 20.

Figure 41:
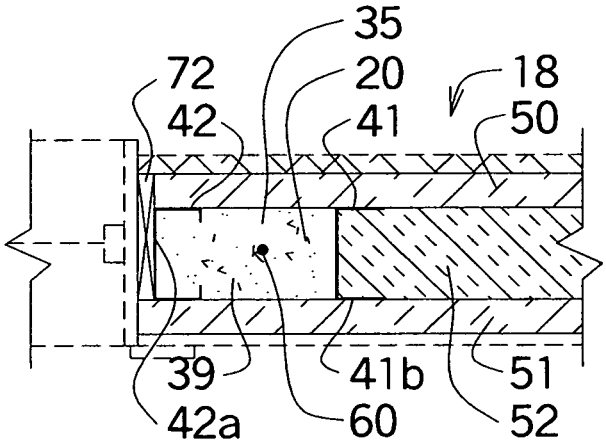
FIG. 41 is a plan view at a window showing the wall forming structure securing the window framing to the wall forming structure.

FIG. 41 shows a wall mold 18 which consists of a rigid board 50 and rigid insulation 51 as the outer surfaces along with the spacer insulation 52 between plus a column mold 20. The column mold structure in column mold 20 is shown with a U channel 41 with its flanges 41*b* encasing the end of the spacer insulation 52 and wood blocking 72 is attached to the web 42*a* of the C channel 42. The wood blocking 72 is used to attach a door or window (shown in ghost) to the wood blocking 72. Additional steel reinforcing 60 is added prior placing the wall mold 18 vertically and then pouring of concrete 39 into the column mold 20. Many of the previously described column mold structures can be used to attach wood blocking 72 to form a door or window at the concrete column 35.

Figure 42:
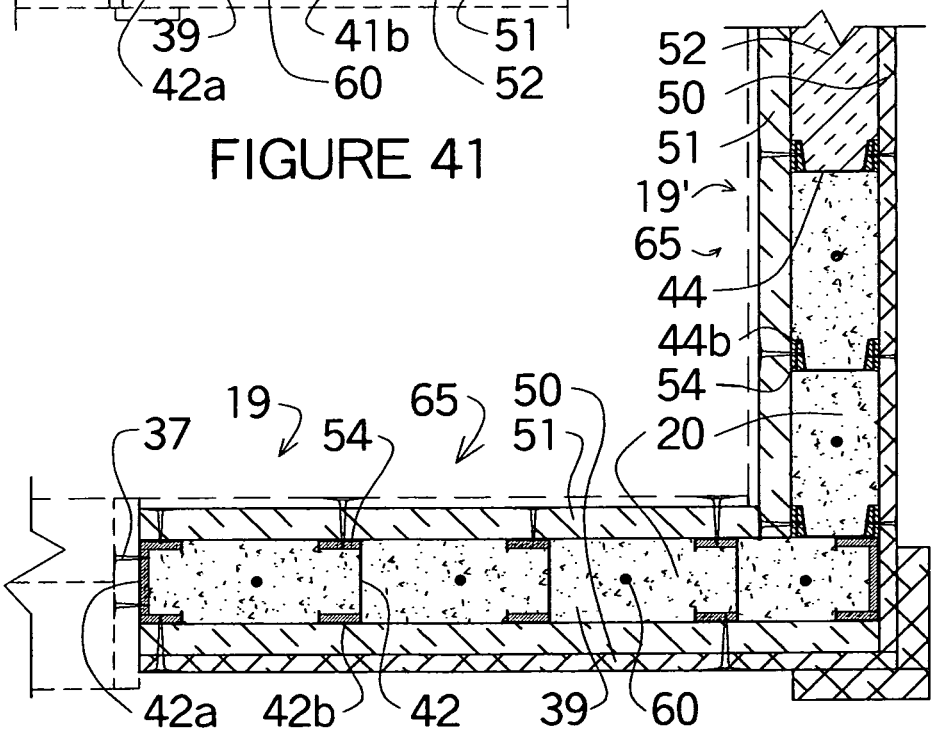
FIG. 42 is a plan view of a corner forming structure showing a L shaped column.

FIG. 42 shows two wall panels intersecting at a corner forming an column mold 20 that is L shaped. The wall panel in wall mold 19 consists of a rigid board 50 and rigid insulation 51 as the outer surfaces of wall panel and an array of C channels 42 with the foam material 54 applied on the flanges 42*b* of the C channels. A door (shown in ghost) has the foam material 54 shown on the interior side of web 42*a* of the C channel 42 so the door (shown in ghost) can be attached to the wall panel after the concrete 39 has cured. No wood blocking 72 is needed to secure the door (shown in ghost) as shown in FIG. 41 since the foam material 54 allows a fastener 37 to be installed directly into the web 42*a* without having to penetrate the concrete 39 as shown in FIG. 41. The wall mold 19' consists of a rigid board 50 and rigid insulation 51 as the outer surfaces of wall panel and the column forming structure consists of an array of bent flange channels 44 with foam material 54*b* installed at the flanges 44*b* plus the spacer insulation 52 installed within the wall mold 19'. The column mold 20 is partially formed in wall mold 19, and partially formed in wall mold 19'. When the wall mold 19 & 19' are installed vertically and connected together, column mold 20 is formed. Additional steel reinforcing 60 is installed within the column mold 20 and concrete 39 is installed when the walls are erected in a vertical position creating an L shaped column. Typically the column mold 20 would be used when two walls molds intersect at 90 degrees or at any angle. The elongated column mold 20 at the corner of a building has the integrity of a solid concrete wall or shear wall (more commonly used like diagonal bracing for wind shear), but in not a solid concrete wall since the spacer insulation 52 separates each concrete column 35 within a building structure. The only connection between each column mold 20 is a concrete beam discussed in FIG. 43 and other drawings.

Figure 43:
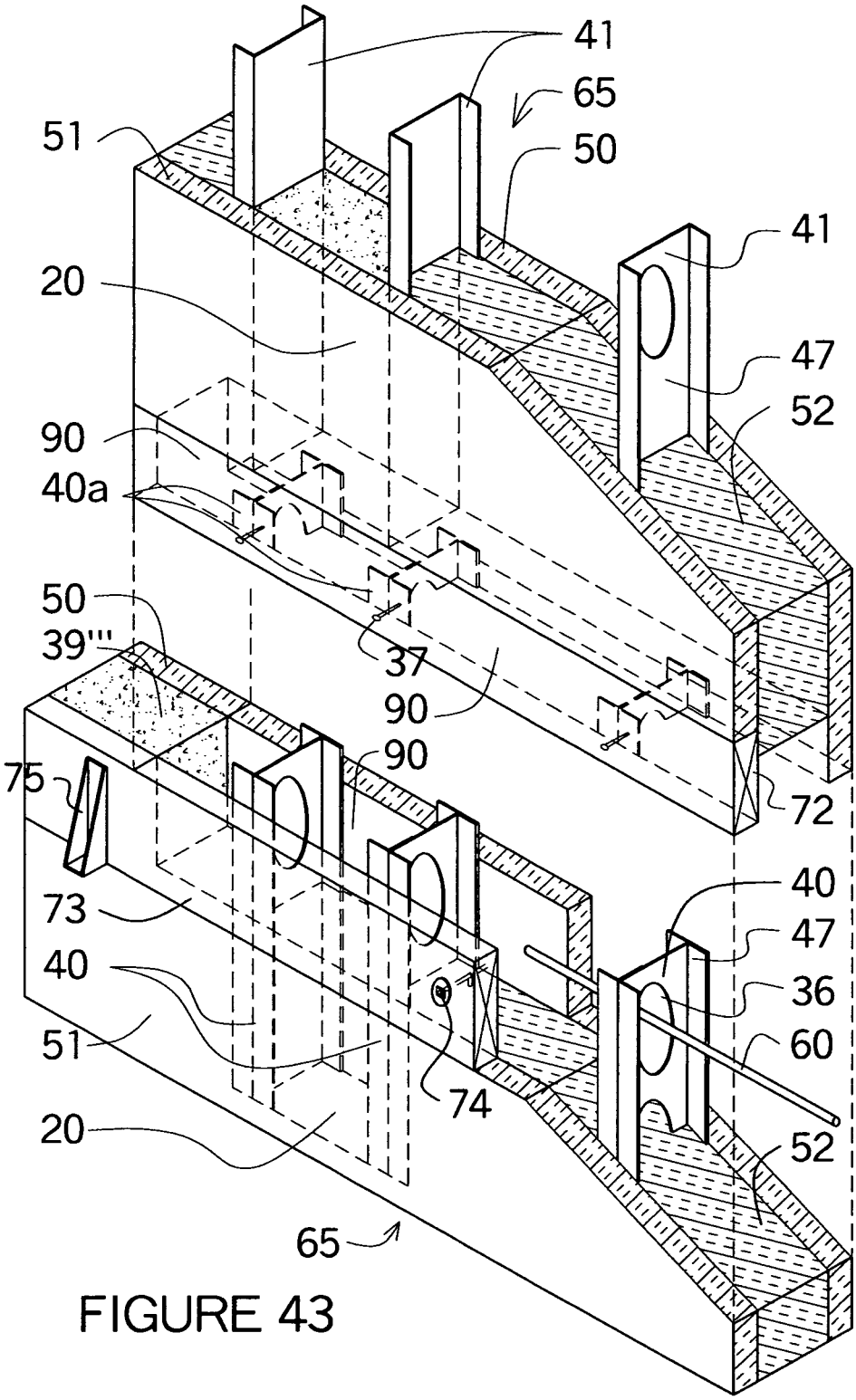
FIG. 43 is an isometric view of horizontal beam, column and another wall forming structure interlocking between each other.

FIG. 43 is a wall section showing two wall panels that is an upper wall panel is installed above a lower wall panel. The wall panel consist of a rigid board 50 and rigid insulation 51 along with the spacer insulation 52 between the outer surfaces. The lower wall panel is shown with a column mold 20 and horizontal beam mold 90 intersecting at the top of wall panel. In the lower wall panel, spacer insulation 52 is shown stopping at the bottom of the beam mold 90. The lower wall panel support channel shows an H channel 40 forming column mold 20, then passing through the beam mold 90 and then extending into the above wall panel. The extension above the lower wall panel is shown in ghost in the upper wall panel and when the upper wall panel is resting on the lower wall panel, fasteners (not shown) connect the rigid board 50 and rigid insulation 51 to the H channels 40 of the lower wall panel. Horizontal steel reinforcing 60 can be installed through the holes 36 in the H channel 40 at the beam mold 90 and at the spacer channel 47 of the beam mold 90. The upper wall panel is shown with U channels 41 as supports for the column mold 20 and is used as a spacer channel 47 in the middle of the spacer insulation 52. The U channels are shown shorter at wall panel above in order to allow for the column mold supports of H channels 40 to be secured with fasteners 37 through the rigid board 50 and rigid insulation 51 thereby connecting the two wall panels together. The column mold 20 can be filled with concrete 39 prior to wall panels being installed. The beam mold 90 can be filled with concrete 39 at the same time as the column mold 20 or the beam mold 90 can be filled with concrete 39 when the column mold 20 is filled with concrete 39. In the lower wall panel, a wood ledger 73 is attached directly to the H channels 40 within the column mold 20 and the spacer channel 47. Anchor bolts 74 are attached directly to the wood ledger 73 and placed within the beam mold 90. The metal joist hanger 75 is attached to the wood ledger 73. A similar light gauge metal joist and metal ledger joist (not shown) can also be in lieu of the wood ledger. Another added feature, is to install wood blocking 72 at a floor line or where horizontal support is required between wall panel.

44 shows a building elevation with various wall panels comprising of concrete beam and column molds configurations with intermediate support channels between the column molds.

FIG. 44 shows a building elevation with various wall panels comprising of concrete beam and column molds configurations with intermediate spacer channels between the column molds. When constructing a building using wall panels, each wall panel requires a different number even though the wall panels are a variation of the previously described wall panels. The wall panels shown in this drawing can be as narrow as 4'-0" wide shown as W1 to intermediate panel widths shown as W2 to full width walls shown as W3. The height H1 of any of the W1, W2 or W3 wall panels could be from the footing 39", including the concrete foundation 39''' to the beam mold 90 at the second floor. Wall panels are sometimes manufactured from column centerlines or from large window jambs depending on the size of the windows. The wall panel W4 is shown in the middle of column mold 20 to the end of the wall mold 32 and extending from the footing 39", including the foundation 39''' to the roof referring to height H3. On the other hand, smaller sections like a foundation wall panel W5 is easier to handle without using a crane (not shown) to install the foundation wall panel W5. Another example would be wall panel W6 as part of an L column mold 20 or a window header mold W5W which incorporated a concrete beam 39''' at the roof line as well as above the door/window WD1. The interlocking panel connection shown in FIG. 43 is shown at the beam molds 90. On the other hand, the wall panel W2 could be two stories high by making the panel heights H1 and H2 as all one panel height. This particular building showed the concrete columns 35 close together, therefore there are not many spacer channels 47. The column mold 20 is shown wider as it depends on the spacing between window/door WD1 & WD2 as well as any floor or roof beams that would affect the size of the column mold 20. For example, the column mold 20 is shown in FIG. 42 as an L shape is used on the right side of the building along with the window detail shown in the same drawing. Another column mold 20 is shown on the left corner of the building that is also L shaped, however the size and number of column support members is less than on the right side. A column mold 20 is shown next to a window WD2 and is a wider column mold. Since a concrete beam 39''' is located between the building floors above, a window header like a concrete beam 39''' is not required. Some of the wall panels show the trough 132, but the horizontal tongue and horizontal bracing channels are not shown.

Figure 45:
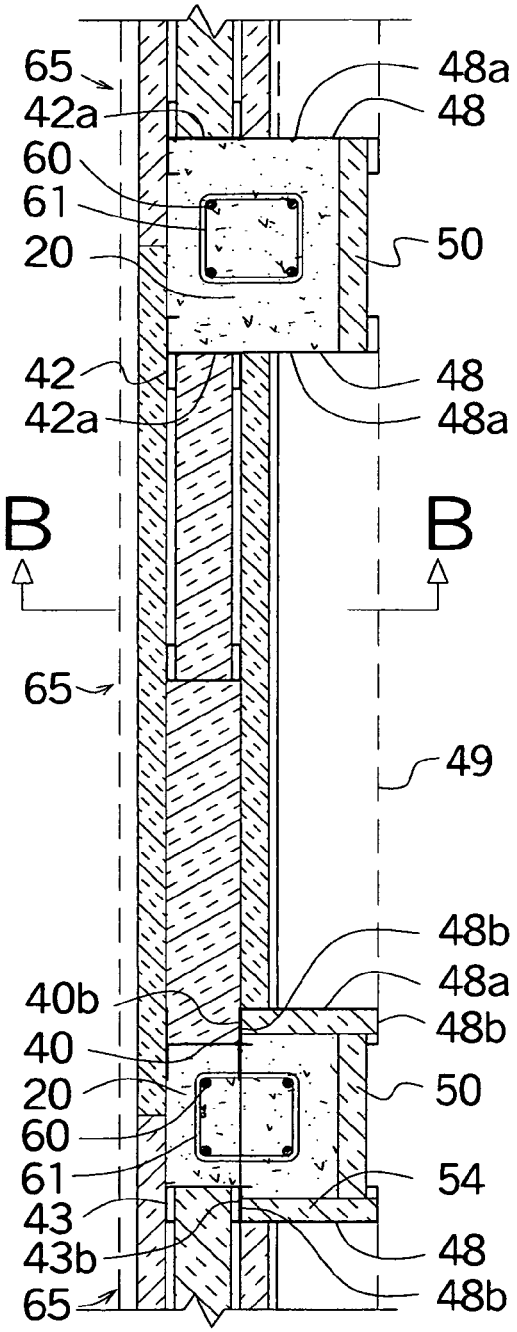
FIG. 45 shows a wall column protruding outside the limits of the wall framing structure.

FIG. 45 shows three wall panels 65 similar to the wall panels shown in FIG. 37, however the column molds 20 are wider than the wall panels 65 between the column molds 20. Column mold 20 shows the same column mold structure of a C channel 42 in one wall panel 65 and an H channel 40 in the other wall panel 65 as shown in FIG. 37. A larger C channel 48 is shown protruding perpendicular to both the wall panels 65 and are connected to the flange 42*b* of the C channel 42 and to the flange 48*b* of the other larger C channel 48. The opposite side of the column mold 20 shows the flange 48*b* of the larger C channel 48 connecting to the flange 40*b* of the H channel 40. The web 48*a* of the large C channel 48 is shown with a foam material 54; however the foam material 54 is not really necessary unless drywall (not shown) is installed over the large C channel 48. Reinforcing steel 60 is installed within the column mold 20 and a steel stirrup 61 passes around the reinforcing steel 60. After the wall panels 65 are installed vertically into place, a rigid board 50 can be installed at the opposite flange 48*b* of each of the large C channels 48 of the wall panels 65. The other column mold 20 shows another larger C channel 48 where the web 48*a* is attached to the web 42 of the C channel 42. The large C channel 48 can be attached to the wall panels 65 prior to the erection the wall panels or can be attached after the wall panels 65 have been erected. The rigid board 50 is installed between the webs 48*a* and connected to the flanges 48*b* after the reinforcing steel 60 and steel stirrups 61 have been installed.

Figure 46:
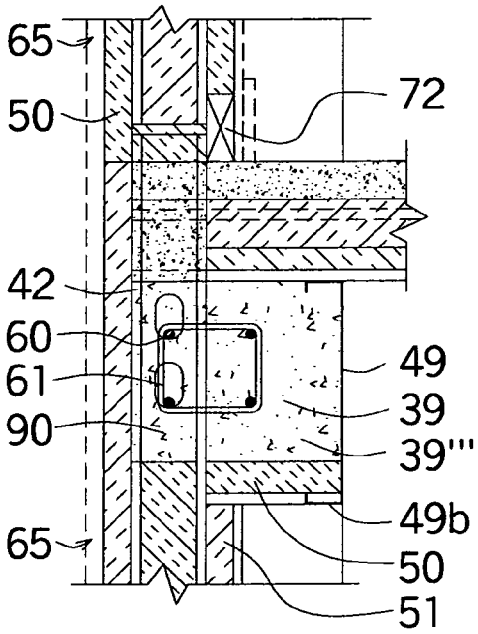
FIG. 46 shows a horizontal beam protruding outside the limits of the wall framing structure.

FIG. 46 is a wall section B-B taken through the middle wall panel in FIG. 45. The wall section B-B shows the beam mold 90 is wider and overhangs the wall panel. A beam support channel 49 is shown dashed in the plan view of FIG. 45 and is supported by the larger C channel 48 of the column molds 20. Horizontal reinforcing steel 60 is installed in the beam mold 90 and steel stirrups 61 are installed around the reinforcing steel 60. A rigid board 50 is placed on the flange 49*b* of the beam support channel 49 and on the rigid insulation 51 of the wall panels. Concrete 39 can now be installed within the beam mold 90 after the wall panel is installed vertical to the height of the beam support channel 49. A steel and rigid flooring system described in a previous patent pending by LeBlang is shown resting on the concrete beam 39'''. The spacer channel 47 shown as C channel 42 extends through the beam mold 90 and past the rigid floor system mentioned earlier and similar to channels extending into the wall above as shown in FIG. 43. The concrete 39 can be poured over the rigid floor system as well as between the C channels 42. After the rigid floor system is complete another wall panel can be placed above the wall panel and attached at the rigid board 50 and at the wood blocking 72.

Figure 47:
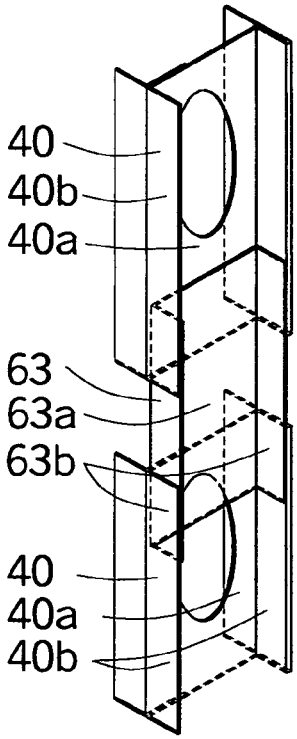
FIG. 47 shows a coupling used to fasten one column forming structure to another column forming structure.

FIG. 47 shows and isometric drawing of H channels 40' & 40 with a coupling 63 connecting the two H channels 40 together. The coupling 63 can be used on any of the support channels, but more specifically shown is the H channel 40' & 40. The coupling 63 is shown connecting to the webs 40*a'* & 40*a* to the web 63*a*, as well as the flanges 40*b'* & 40*b* being connected to the flanges 63*b* of the coupling 63. When a column forming structure or interior channel as described earlier is not long enough for a wall panel, a coupling 63 can be used to connect two channels together.

Figure 48:
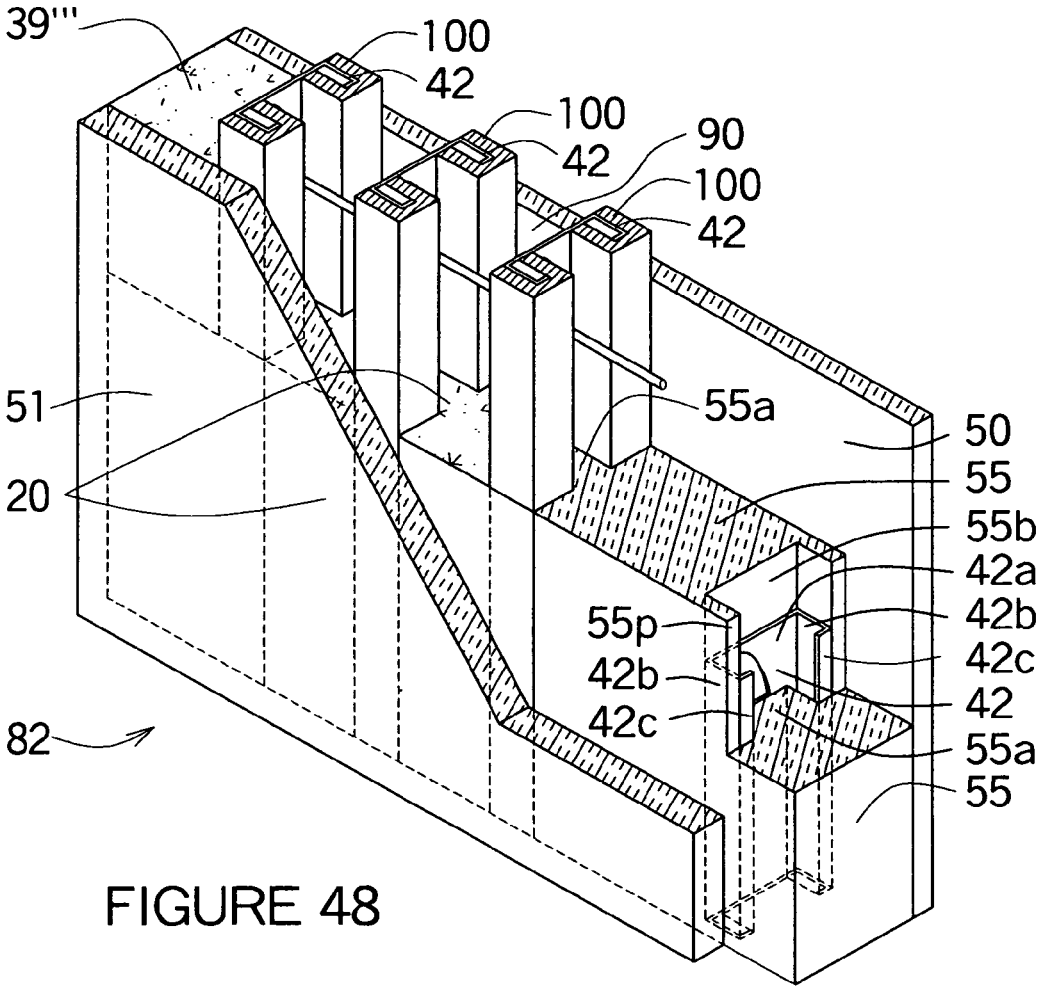
FIG. 48 shows an isometric drawing using a C channel as the wall forming structure.

FIG. 48 shows the support channels as shown as C channels 42 with insulating foam 100 secured around the flange 42 and the lip 42*c* when the C channels extend into the beam mold 90 supported by rigid board 50 and rigid insulation 51. The insulating foam 100 slides around the lip 42*c* making the insulating foam 100 easier to install around the C channel 42. The insulating foam 100 is installed typically only where the beam mold 90 passes the C channel 42 within the wall mold 82. In addition the foam spacer 55 has a different tongue shape 55*a* and groove shape 55*b* configuration since the C channel 42 is used in FIG. 48. The foam spacer can be changed to fit any size or shape of support channels.

Figure 49:
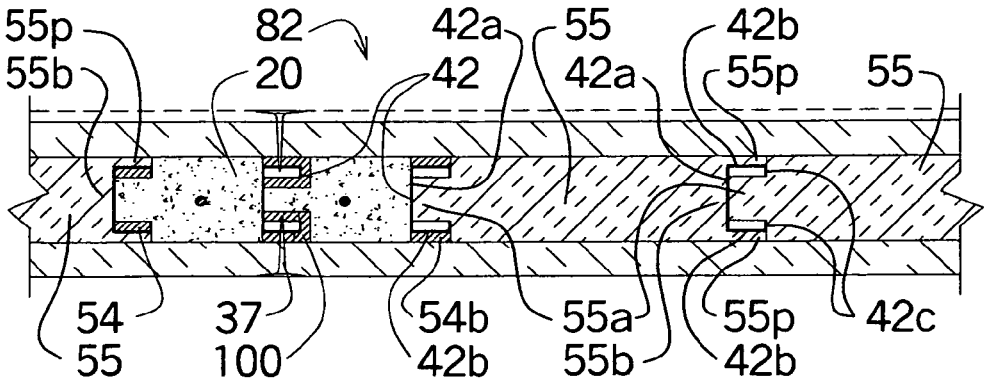
FIG. 49 shows a plan view of the C channel as the wall forming structure.

FIG. 49 shows a plan view of the wall mold 82 shown in FIG. 48. The insulation foam 100 is shown at the center C channel 42. The C channel 42 on the left side of the column mold 20 shows the foam spacer 55 over lapping the C channel 42 at the flange 42*b* at the groove shape 55*b* with a projection 55*p* extending the length of the flange 42*b*. A foam material 54 at the interior of the column mold 20 is connected at the flange 42*b* of the C channel 42. The left C channel 42 at the column mold 20 can be reversed as shown at the right C channel 42 of the column mold 20. The right C channel 42 of the column mold 20 is shown with foam material 54 at the flanges 42*b*. The foam material 54 can be incorporated as part of the foam spacer 55 as shown as the projection 55*p* of the groove shape 55*b*. The projection 55*p* and the groove shape 55*b* of the foam spacer 55 encases the outside face of the web 55*a* and the flanges 42*b* of the C channel 42 and the projection 55*p* extends to the lip 42*c*.

Figure 50:
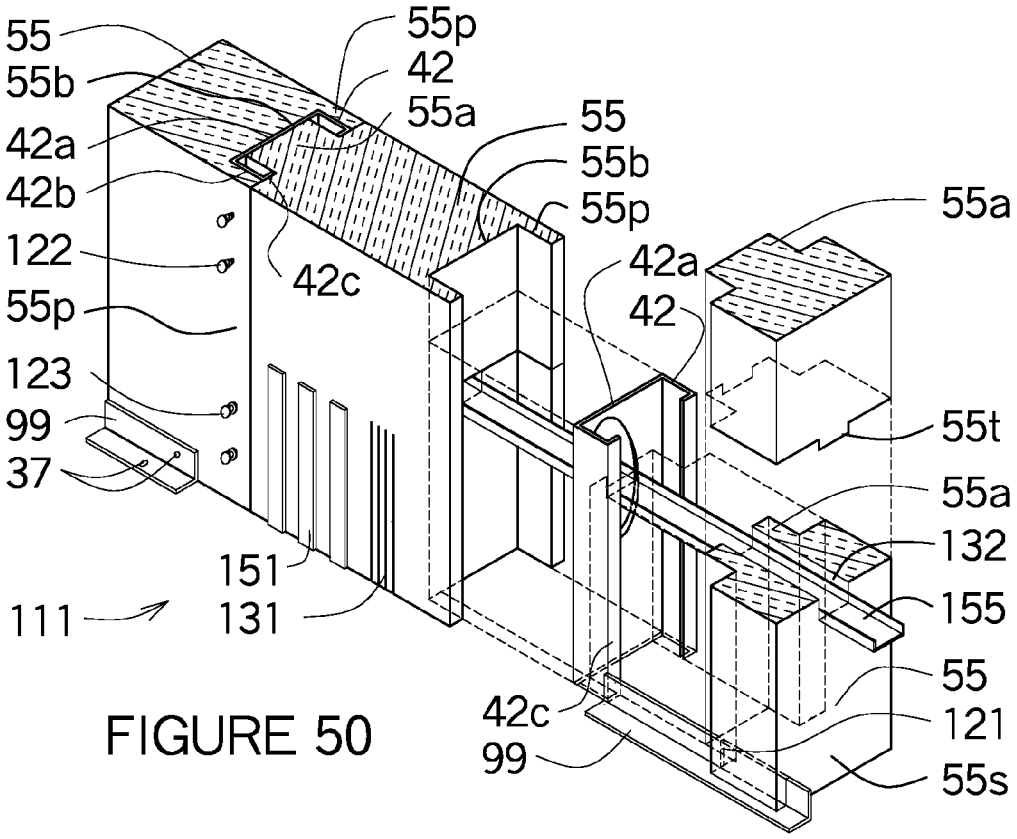
FIG. 50 shows the tongue and groove assembly at the structural insulation core.
Figure 52:
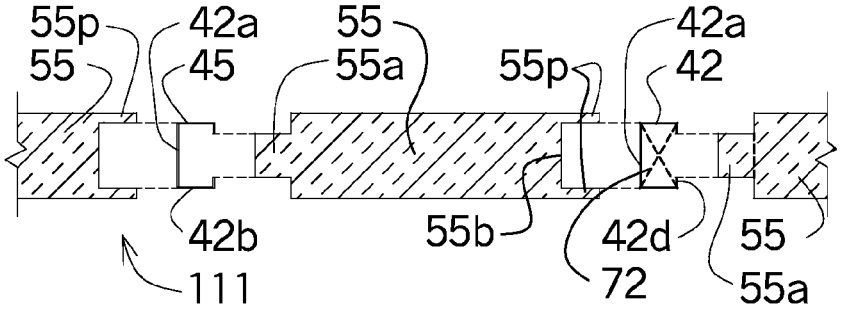
FIG. 52 show a plan view with the tongue and groove assembly using the C channel at the structural insulating core.
Figure 53:
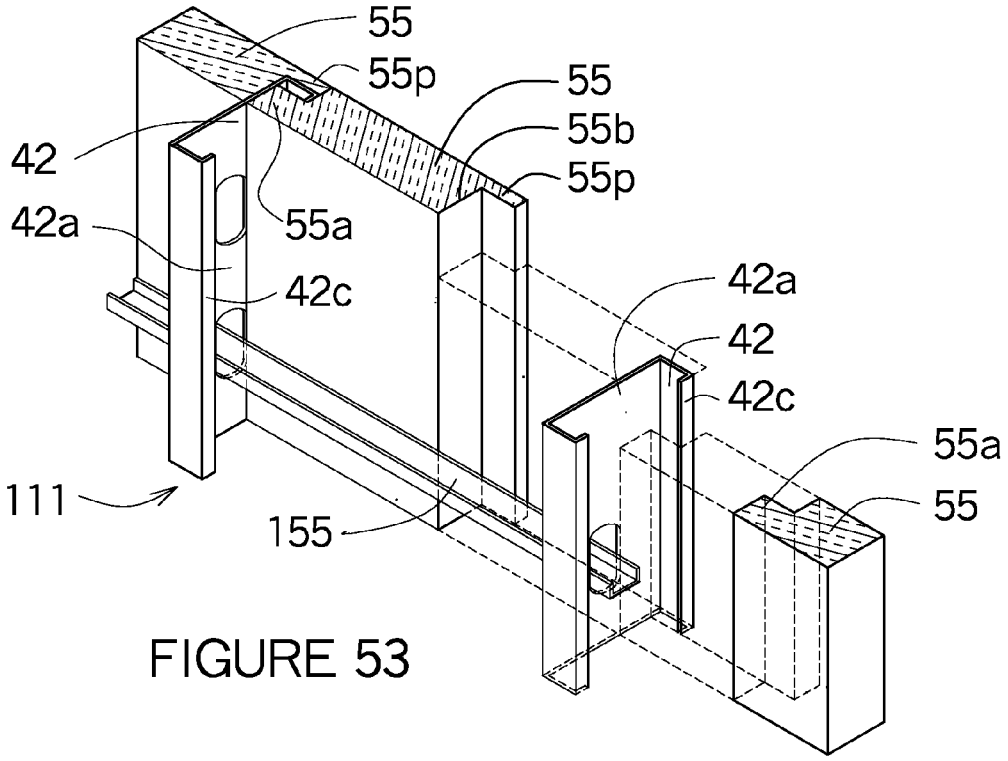
FIG. 53 shows an isometric view of a thinner tongue and groove foam spacer with a C channel wall structure.
Figure 55:
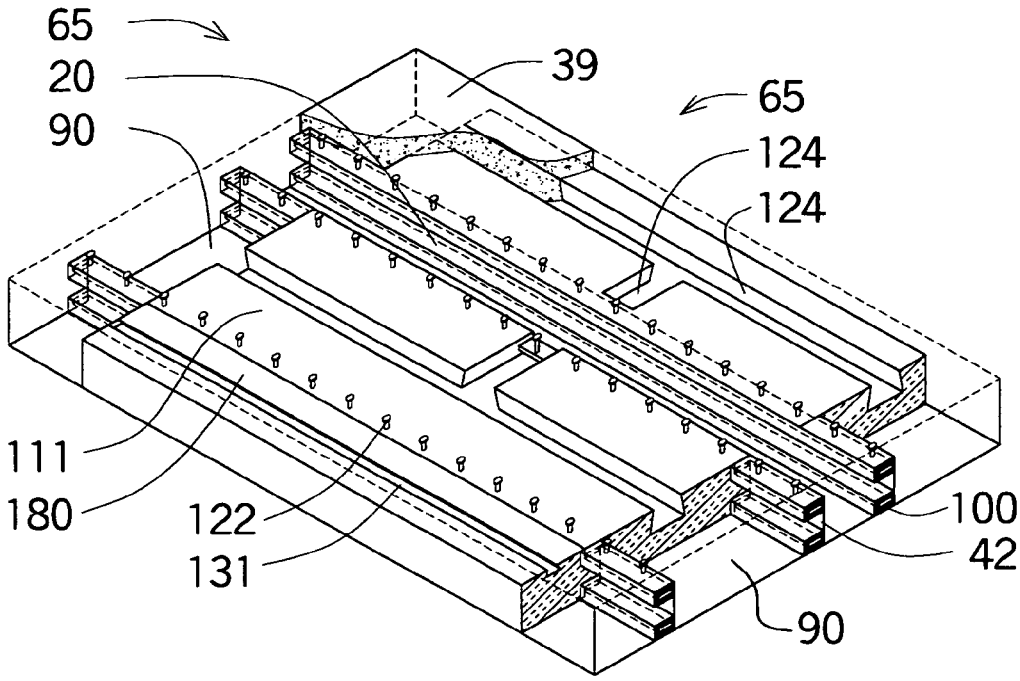
FIG. 55 shows an isometric view of precast wall mold when the concrete is poured over the structural insulating core.

FIG. 50 shows an isometric drawing of the structural insulating core 111 without the rigid board and rigid insulation as previous discussed in FIG. 48 consisting of two C channels 42 and three foam spacers 55 that are wider than the C channels 42. The foam spacer 55 between the C channels 42 abuts the web 42*a* at the tongue shape 55*a* of the foam spacer 55 and the foam spacer 55 abuts the lip 42*c* at the C channel 42 on the left. The opposite end of the foam spacer 55 has the groove shape 55*b* where the web 42*a* of the C channel 42 fits into. Since the foam spacers 55 are wider than the C channels 42 the excess foam spacer on both sides of the C channel 42 forms a projection 55*p* that overlaps both flanges 42*b*. The tongue and groove configuration shows how the foam spacers can easily fit together between the C channels 42. The projections 55*p* of the foam spacers 55 can easily be screwed or glued to the C channels 42. The webs 42*a* can easily be glued to the foam spacers 55 creating a stronger structural insulating core 111. FIG. 52 also shows the foam spacers 55 and C channels 42 in a separated position prior to securing the foam spacers 55 together creating a structural insulating core 111. In FIG. 52 the C channel 42 can be wood blocking 72, however the tongue space 55*a* is not required in the foam spacer 55. The structural insulating core 111 can be used as an independent wall; an interior core for of the columns and beam molds previously described; and as a forming structure in a precast wall which is described in FIG. 55-56. A screw 122 and double headed fastener 123 are shown secured through the foam spacer 55 at the projection 55*p* or into the insulating foam 100 to connect precast concrete walls to the structural insulating core 111. Attaching the screw 122 and/or the double headed fastener 123 to the structural insulating core 111 provides as thermal break with the C channels 42 as well as providing a means of securing a structural insulating core 111 to concrete as shown in FIG. 55. When the structural insulating core 111 is installed within a wall mold 82 as shown in FIG. 48, and the rigid board 50 and rigid insulation 51 are all glued together, the wall mold would then be considered a structural insulated panel (SIP). Usually a SIP has a foam core with wood blocking and a rigid board 50 made of plywood on both sides of a foam core. By making the interior of a SIP with a structural insulating core 111, SIP's would be able to support a greater structural load for both a wall or a roof load since everything is glued together. Also shown are drainage channels 151 that protrude from the structural insulating core 111 to create an air space should it be required when some exterior surface finish materials (not shown) are applied over the structural insulating core 111. In addition a recessed groove 133 is shown on the exterior face of the structural insulating core 111 to allow water drainage between the structural insulating core 111 and various stucco applications. Since the structural insulating core 111 is a solid wall, two methods are shown to secure the structural insulating core 111 to a floor 175. Base plate angle 99 is shown attached to the C channel 42 at the flange 42*b* and the floor 175; however a groove 121 is cut into the structural insulating core 111 at the base plate angle 99. Another method is to install the base plate angle 99 on the surface of the structural insulating core 111 and connect to the flange 42*b* of the C channel 42 using a fastener 37 and thereby having a thermal break between the C channel 42 and the base plate angle 99. A trough 132 is shown in the middle of the structural insulating core 111 and is aligned with the holes 36 of the C channel 42 for use as an electrical chase within the structural insulating core 111. In some cases the trough 132 is required to be metal channel (not shown) for compliance with some electrical codes. In addition, the trough 132 can be used to install a horizontal bracing channel shown as a horizontal U channel 155 or as shown in FIG. 53 connecting the C channels 42 within the structural insulating core 111. Usually the holes 36 within the C channels 42 are spaced 24" apart so the trough 132 could be installed to align with the holes 36 therefore making the foam spacers 55 be shorter pieces rather than the full height of the wall. The horizontal bracing channel is shown within the trough 132 passing through the holes 36 within the C channels 42 and into the adjoining foam spacer 55. The C channels 42 and the horizontal bracing channel can also be shorter in length and used as brackets to secure four adjacent foam spacers 55 together. The foam spacers 55 or a smaller foam spacer 55*s* are shown with a tongue 55*t* that fits into the trough 132 in the foam spacers 55. When the four small foam spacers 55*s* intersect the tongues 55*t* of two small foam spacers 55*s* fit into the troughs 132 of the two small foam spacers 55*s* below; plus the horizontal bracing channel connects the two small foam spacers 55*s* together as well as the C channel 42 because the horizontal bracing channel has a hole 36 in the web 42*a* locking the C channel 42 with the tongue shape 55*a* and the groove shape 55*b* together. The smaller foam spacers 55*s* can be installed together without support channels since the tongue shapes 55*a* and the groove shapes 55*b* interlock between smaller foam spacers 55*s* as well as the horizontal bracing channel within the troughs 132 plus the tongues 55*t* fitting into the troughs 132 together form a structural insulating foam core wall.

Figure 51:
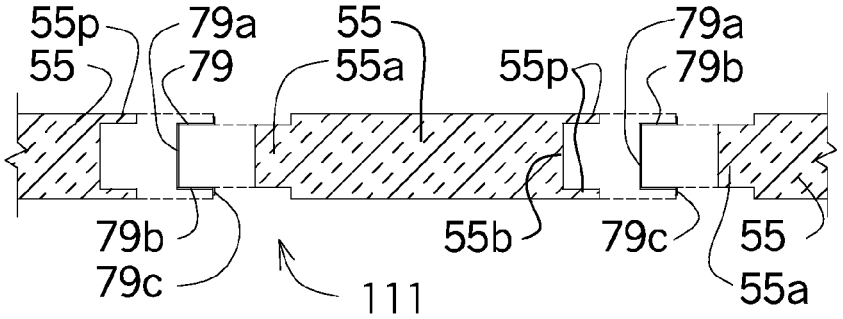
FIG. 51 shows a plan view with the tongue and groove assembly using the reverse lip channel at the structural insulating core.

FIG. 51 shows a plan view of FIG. 50 except here two reverse lip channels 79 are used between three foam spacers 55. The reverse lip channel 79 is similar to the C channel 42 in FIG. 34, except the lip 79*c* is bent in the opposite direction as the lip 42*c*. The tongue shape 55*a* fits against the web 79*a* of the reverse lip channels 79 and the groove shape 55*b* fits against the adjacent reverse lip channel 79 at the web 79*a* and the projection 55*p* of the foam spacer 55 fits against the flanges 79*b* and abuts the lip 79*c*. Since the structural insulating core 111 has a snug fit between the reverse lip channels 79 and the foam spacers 55, the wall panel can be glued together. The reverse lip channel 79 and the C channel 42 have the same physical characteristics since the lip 79*c* & 42*c* function in the same way giving the reverse lip channel 79 the same strength as the C channel 42. In addition, the reverse lip channel 79 can also be use in place of the horizontal bracing channel where ever it has been used.

Figure 54:
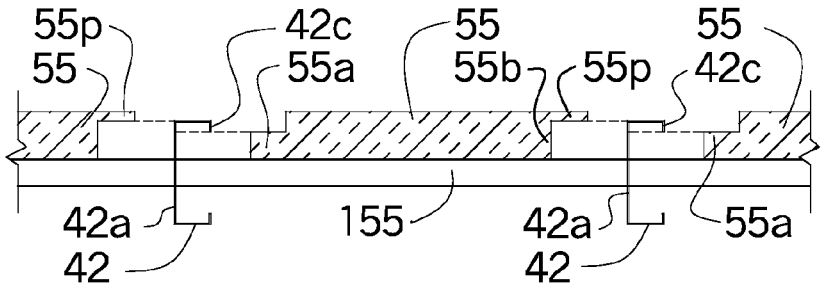
FIG. 54 is a plan view showing the thinner tongue and groove foam spacer using a C channel as the structure component of the wall.

FIG. 53 is similar to FIG. 50 except the three foam spacers 55 of the structural insulating core 111 is less than the thickness of the foam spacers 55 in FIG. 50. The foam spacers 55 extends beyond the webs 42*a* of the adjoining C channels 42 enough to create a thermal break and cover the C channels 42 with the same projection 55*p*. The open portion of the C channel 42 has a lip 42*c* where the tongue shape 55*a* fits between and a horizontal bracing channel (typically used to connect adjacent C channels within the building industry and shown here as a horizontal U channel 155) plus the opposite end of the foam spacer 55 also fits between the webs 42*a* of the adjacent C channel 42. Since the foam spacer 55 overlaps and fits between the webs 42*a* of the C channel 42, the projection 55*p* and the foam spacer 55 are wall insulations as well as a wall sheathing material, both the foam spacer 55 and a wall sheathing material can all be made together as one material. FIG. 54 is a plan view of a wall panel showing the tongue shape 55*a* and groove shape 55*b* and the projection 55*p* of the foam spacer 55 between the C channels 42 as shown also in FIG. 53. In FIG. 54 the C channel 42 can be wood blocking, however the tongue space 55*a* is not required in the foam spacer 55 and the horizontal bracing channel is not required.

Figure 56:
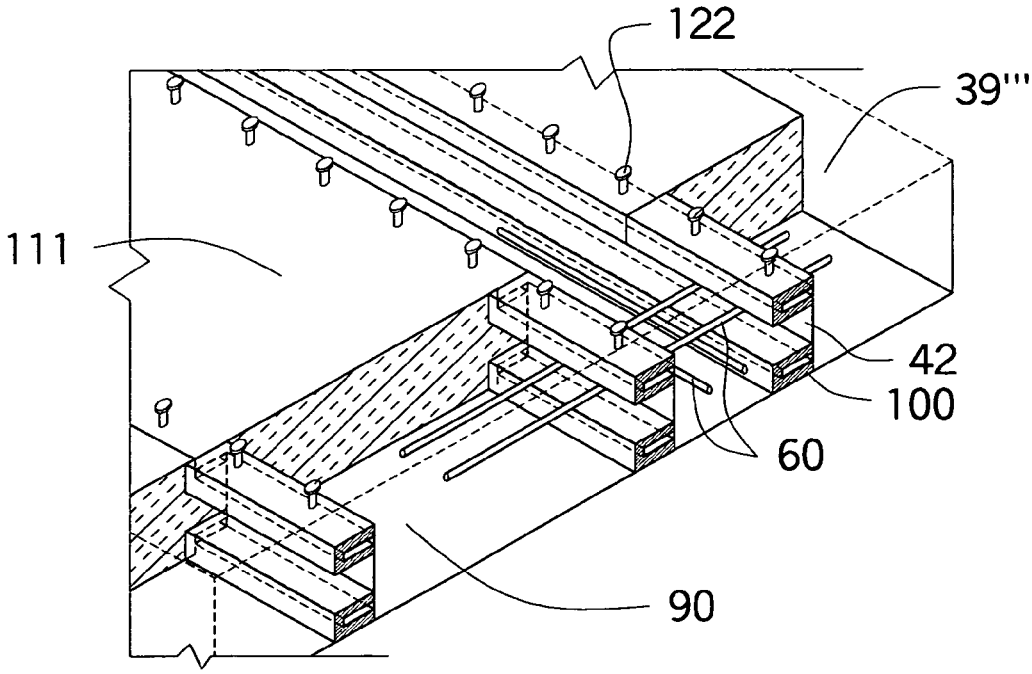
FIG. 56 shows and enlarged view of the column and beam in the precast wall when the concrete is poured face up.

FIG. 55 shows an isometric view of a wall panel where the concrete 39 is poured on top of the structural insulating core 111 of the precast mold 180. Any of the previous described structural insulating cores 111 with either the spacer insulations, foam spacers 55 or supporting channel configurations can be used to form a precast mold 180. The previously described wall molds were first erected vertically then the hardenable material was poured into the wall molds, that is into the column and beam molds, while here the precast molds are laid horizontally and then the hardenable material is installed into the molds. The structural insulating core 111 shown here is similar to FIG. 48, however the rigid board 50 is not required and concrete 39 is used instead as the exterior wall material. The rigid insulation 51 shown in FIG. 48 can be used as the bottom of the precast mold 180 or a forming bed typical used in precast construction can be used. The C channels 42 of the structural insulating core 111 is shown extending into a beam mold 90 at the ends of the wall panel. The insulating foam 100 fits over the C channel 42 at the bottom of the beam mold 90 so drywall (not shown) or other materials can be attached after the concrete 39 has cured. Screws 122 or double headed fasteners (not shown) are attached through the structural insulating core 111 into the C channel 42. In addition a recessed groove 131 is installed to additionally secure the structural insulating core 111 to the concrete 39. Also to add additional strength to the wall panel, a rib 124 is installed parallel to the C channel 42 and another rib 124 is installed perpendicular to the C channel 42 in the structural insulating core 111. The ribs 124 add additional strength to the concrete 39 allowing the C channels 42 to be spaced further apart. The precast mold 180 is complete when the wall panel has side boards (not shown) are installed. Additional steel reinforcing (not shown) is installed in the beam molds 90 and the column mold 20 and concrete 39 is poured over and into the precast mold 180 when the precast mold 180 is in a horizontal position. Since the concrete 39 passes through the holes 36 (not shown) in the C channel 42 of the beam mold 90, the C channel 42 is secured to the structural insulating core 111. In addition, ribs 124 and grooves 121 are also installed on the structural insulating core 111 to add additional bonding strength to the concrete 39 bonding to the structural insulating core 111. When the ribs 124 and recessed grooves 131 are added to the structural insulating core 111, the screws that are secured to the C channel 42 might not be required to secure the concrete 39 to the structural insulating core 111. FIG. 56 is an enlarged view of the beam mold 90. Many of the other previously described wall molds can also be used to form the precast mold 180.

Figure 57:
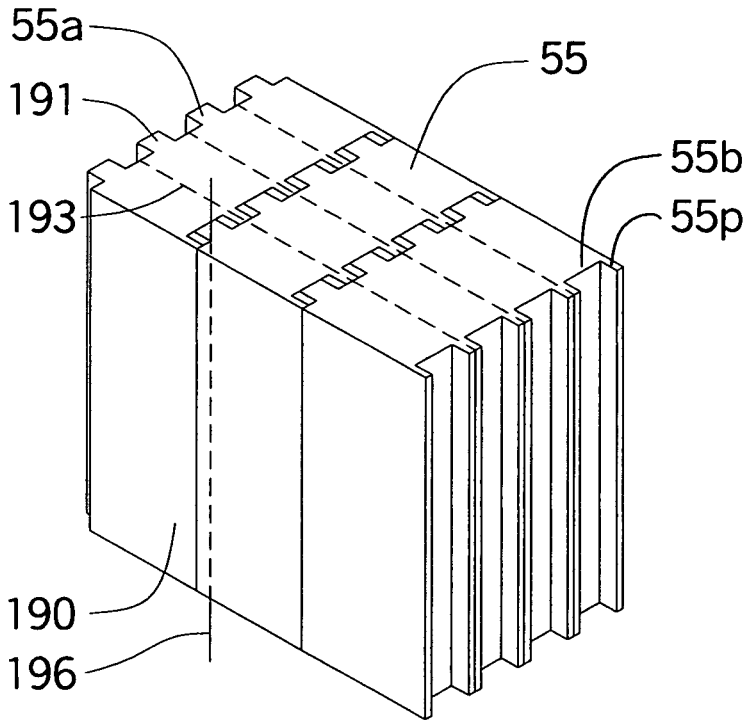
FIG. 57 is an isometric showing the mold and cutting process for the tongue and groove structural insulating core.

FIG. 57 shows an isometric drawing of a large foam block 190. The foam block 190 has a tongue mold 191 and a groove mold 192 on each side of the foam block 190. The previous drawings shown have many different types of channels within the various wall molds, wall panels as well as the various column and beam molds, therefore the foam spacer 55 and structural insulating cores 111 all have a different configuration at the channels. FIG. 57 shows the foam spacer 55 in FIGS. 50 & 52. The foam block 190 is cut into smaller shapes by using a wire that when heated electric current in the hot wire cuts the foam material into many different shapes including foam spacers. By cutting the tongue shape 55*a* several foam spacers are being cut with the hot wire at the same time. The length of the foam blocks is cut at the groove shapes 55*b*, however the tongue shaped including the projections 55*p* is being cut at the same time. The process continues cutting the tongue and groove shapes until the foam block is fully cut. The foam block is now required to be turned 90 degrees so the foam block can be cut to the desire thickness of the spacer block and then rotated and turned 90 degrees to cut the height of the foam spacers. The foam spacer can also be cut to form and electric chase between blocks making the length cut to include the electric chase.

Figure 58:
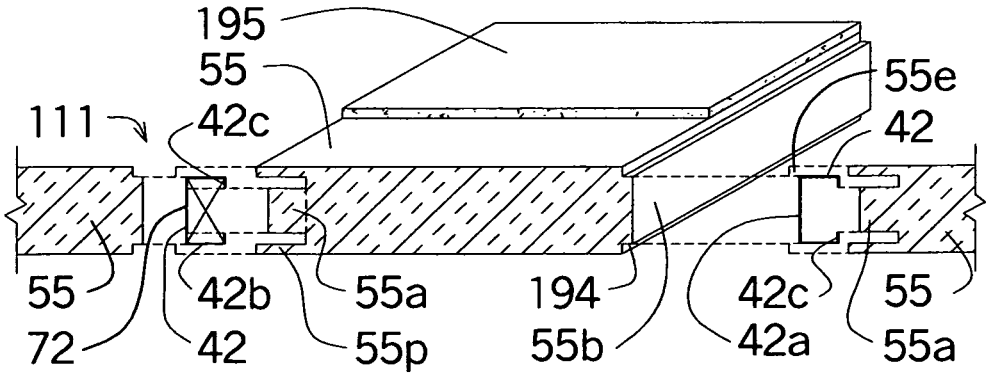
FIG. 58 is an oblique view of a different structural insulating core panel also shown with a thin cementitious coating.

FIG. 58 shows a plan view of a structural insulating core with an alternate shape for the foam spacer 55. The foam spacer 55 shows a protruding tongue 55*a* and a projection 55*p* on the same side of the foam spacer 55. The tongue shape 55*a* is the same as in FIG. 50 where the tongue shape 55*a* fits between the 42*c* of the C channels 42 and abuts the web 42*a* when installed in place. In FIG. 58, the projection 55*p* extends past the web 42*a* and is longer than the flange 42*b* of the C channel 42. The additional length of the projection 55*p* is shown as an extension 55*e* of the foam spacer 55 is the equal to the length of the flange 42*b* plus the length of the recess 194 where the foam spacer 55 abuts is longer than the flange 42*b* of the C channel 42 thereby overlapping the adjacent foam spacer 55. What is shown in FIG. 58 is that the foam spacer 55 can be cut into any configuration and still be installed next to an adjacent C channel 42 using the same configured foam spacer 55. The support member in the structural insulating core can be formed with wood blocking 72 or the C channel 42. If the wood blocking 72 (as shown by an X) is used, the tongue shape no longer extends to the web 42*a* but abuts the wood blocking 72 and the projection 55*p* still rests in the recess 194 of the groove shape 55*b* of the adjacent foam spacer 55. Inner and outer boards can be installed over the structural insulating core to foam a structural insulated panel (SIP). In addition, a cementitious coating 195 can be installed on any of the foam spacers 55 prior to being installed in the C channels 42.

Figure 59:
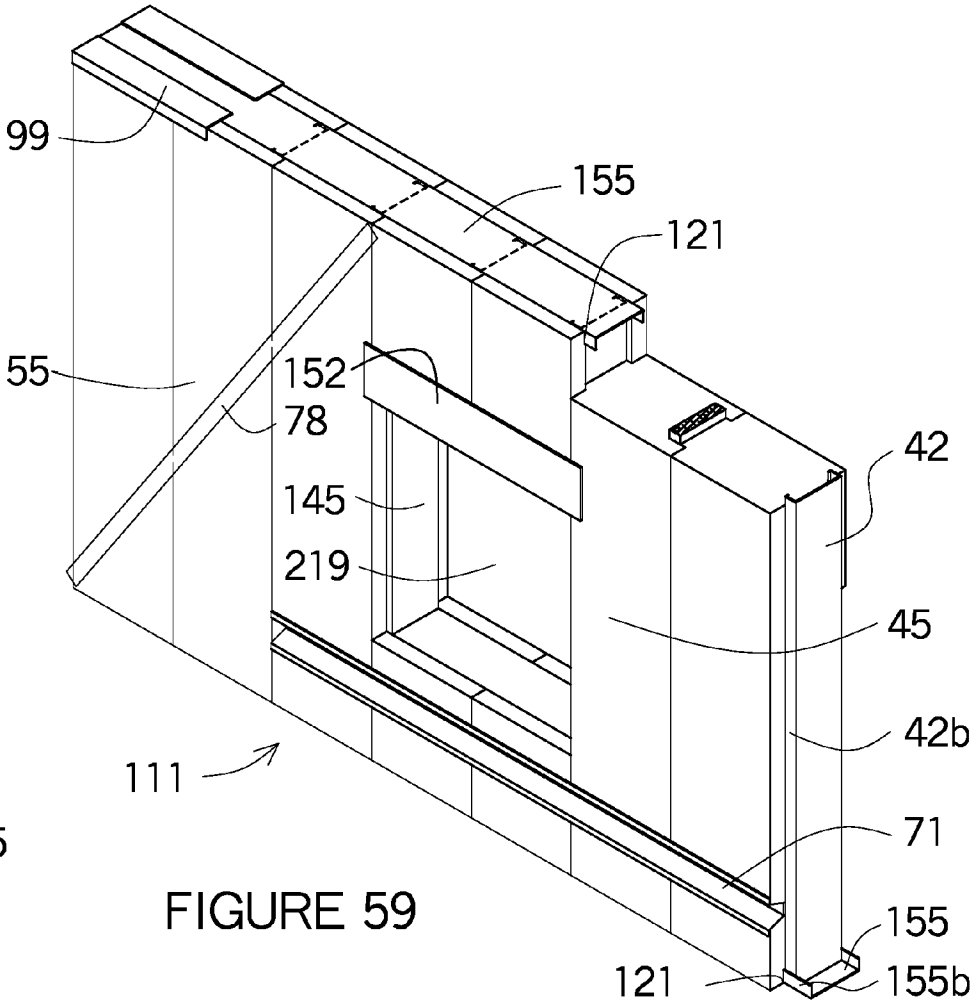
FIG. 59 shows a full height structural insulating core with the diagonal bracing and bracing plate for the metal framing within the core panel.
Figure 60:
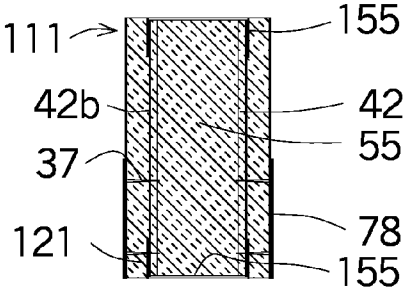
FIG. 60 shows the bracing plate above a window opening.
Figure 61:
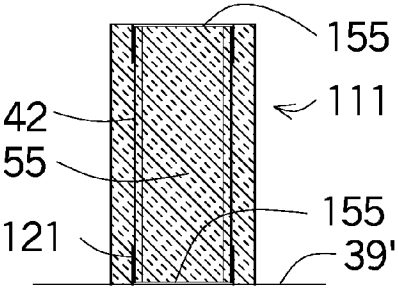
FIG. 61 shows a vertical wall section of the structural insulating core.
Figure 62:
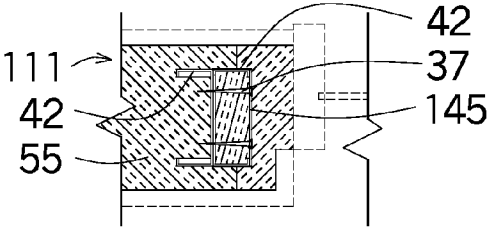
FIG. 62 shows a plan view of a window jamb at a structural insulating core.

FIG. 59 shows a full height wall panel consisting of a base plate 120 at the top of bottom of the wall panel with an array of C channels 42 spaced between the foam spacers 55. Enlarged detail is shown in FIG. 60, and a wall section in FIG. 61 plus a plan window section shown in FIG. 62. An enlarged cross-sectional view of the wall panel is shown in FIG. 50, also shown as the structural insulating core 111, consisting of the foam spacer 55 and the C channels 42. The groove 121 in the foam spacer 55 is shown in FIG. 59 at the top and bottom of the wall panel for the base plate 120 to fit through. The diagonal bracing 78 can be used vertically; horizontally or diagonally to connect the C channels 42 within the rigid wall panel. The diagonal bracing 78 is installed over the foam spacer 55 with fasteners 37 into the flange 42*b* of the C channel 42. FIG. 60 shows the bracing plate 152 attached to the C channel 42 above the window opening 219. Also shown is a base plate angle 99 at the top of the wall in lieu of using the base plate 120 also shown in FIG. 50. FIG. 62 shows a plan view of the C channel 42, another C channel 42 that has a cripple stiffener 145 that attaches to the second C channel 42 which is typically used in light gauge framing. Additional insulation is shown around the window opening 219. The support member in the structural insulating core can be formed with wood blocking 72 or the C channel 42.

Figures 63, 64:
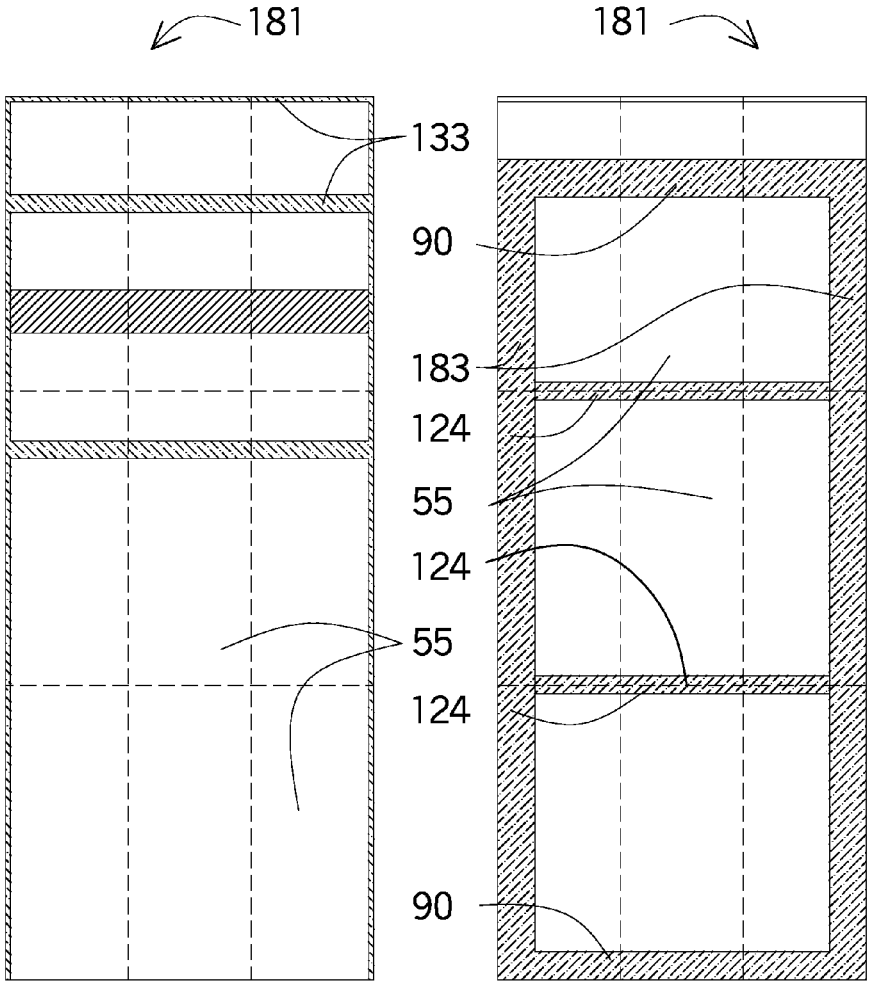
FIG. 63 is an exterior elevation of a precast wall where the structural insulating core has architectural delineations.
FIG. 64 is the interior elevation of a precast wall where the structural insulating core has grooves for columns and beams.

FIG. 63 shows the front elevation of a wall panel and FIG. 64 shows the rear of the same wall panel. Since a wall panel can be at least 10 feet wide by 35 feet tall, smaller aerated autoclave concrete sections of the foam spacer 55 or foam insulation 52 with rigid board 50 can be used to form beam molds 90 and column molds 20 within the wall panels and when the wall panels are place adjacent to one another the wall mold 181 is formed. In FIG. 55 concrete 39 is poured over the wall molds, however when the concrete 39 is eliminated and the foam spacer 55 is exposed, ribs 124 are required at the joints between the foam spacer 55 wall sections. The front elevation shown in FIG. 63 has various architectural reliefs shown in FIG. 50 as a protruding drainage channel 151 or a recessed groove 133. The architectural reliefs can be installed in the aerated concrete prior to autoclaving when the aerated concrete is soft and can be cut by wire or pressed into the desired shape or can be cut after autoclaving by cutting with a saw or by hot wire cutting.

CONCLUSION AND SCOPE OF INVENTION

The building panel comprises a structural insulating core of structural support members and spacer blocks that fit between the structural support members. The foam spacers are thermal blocks that are wider than the support members that interlock between other foam spacers and structural support members which when assembled together form a wall. Several types of support members such as metal channels or wood framing members fit between the support members and interlock together with a tongue and groove connections both vertically and horizontally. Many different configurations of the vertical and horizontal tongue and groove connections are shown. Horizontal bracing channels interlock between the support members and spacer blocks along with the horizontal tongue and trough connects interlock the spacer blocks together. The tongue and groove connections allow the foam spacers to just slide together without fasteners or mortar to hold them in place. The foam spacers can be made from a variety of closed cell materials that resist heat transfer and are good insulating materials like polystyrene, aerated autoclave concrete, concrete with polystyrene beads and cellular lightweight concrete.

The foam spacers with the tongue and groove connections can have brackets or short support channels and horizontal bracing channels to hold the spacer blocks together. Full height support channels can be used with short horizontal bracing channels to construct a wall as well as short support channels and long horizontal bracing channels connecting many foam spacers together can also for a wall.

The structural insulating core can be used as an independent wall, screwed or glued to together to form a SIP or together to form a larger structural insulated panels.

It is understood that the invention is not to be limited to the exact details of operation or structures shown and describing in the specification and drawings, since obvious modifications and equivalents will be readily apparent to those skilled in the art. The flexibility of the described invention is very versatile and can be used in many different types of building applications

The invention claimed is:

1. A structural insulating core wall of a building comprising:

spaced apart flanged vertical metal support channels with holes extending therethrough, and;

spacer blocks positioned between and at least spanning the distance between flanged metal horizontal bracing channels, the horizontal bracing channels aligned with and extending through the vertical metal support channel holes, the blocks comprising:

a block depth dimension being substantially greater than the distance between the vertical metal support channel flanges, a vertically oriented groove and a corresponding transverse mating tongue fully extending along a transverse length of facing, opposed side block surfaces, the groove and tongue surfaces contacting and encompassing the two vertical metal support channel flanges, a trough and corresponding horizontal tongue fitting together and aligned with holes in the support channels, the horizontal bracing channels secured between the trough and corresponding horizontal tongue;

a base angle groove running perpendicular to the tongue and groove, the base angle groove located in a bottom face of a bottom block and positioned from a front or a back block surface a dimension equal to a foam thickness from the front or the back of the block to the channel flange; and, a base plate having flanges inserted in a base angle grooves of the blocks;

wherein the base plate flanges are secured to the channel flanges and secured to a building floor adjacent the structural insulating core wall.

2. The structural insulating core wall of claim 1 wherein the core wall is positioned at an angle to form a building roof.

3. The structural insulating core wall of claim 1 wherein the support channel consists of a web with two flanges that are sloped or each bent 90 degrees to the web and bent again parallel to the web 90 degrees forming a lip that extends outward from the two flanges in an opposite direction to the lip of a C channel.

4. The structural insulating core wall of claim 1 wherein the trough is large enough to accommodate mechanical means through the holes in the support channels.

5. The structural insulating core wall of claim 1 wherein the spacer block has a tongue side fitting against a support channel web and lip with an indentation and the opposed side of the spacer block fits against the web of an adjacent support channel so the projection and extension fit over the flange into the indentation.

6. The structural insulation core wall of claim 1 wherein the spacer block has a tongue side fitting against the web and lip of a support channel and projections and extensions fitting on the flange of the support channel, and the opposed side of the block fits against the web of an adjacent support channel so the projection and extension of an adjacent block fits over the flange into an indentation.

7. The structural insulation core wall of claim 6 wherein inner and outer rigid boards are attached to flanges located on both sides of the support channels, the blocks positioned between the inner and outer rigid boards, the boards fully extending between the support channels and longitudinally extending from the bottom of the support channels to the top of the wall.

8. A structural insulating core wall of a building comprising:

spaced apart flanged vertical metal support channels with holes extending therethrough, and;

spacer blocks positioned between and at least spanning the distance between flanged metal horizontal bracing channels, the horizontal bracing channels aligned with and extending through the vertical metal support channel holes, the blocks comprising:

a block depth dimension being equal to the distance between the vertical metal support channel flanges, a block width having a groove and a transverse mating tongue fully extending along the transverse length of facing, opposed side block surfaces, an interlocking tongue space and groove space such that the tongue shape has a recess into which projections overlap the adjoining spacer block, a vertically oriented groove and a corresponding transverse mating tongue fully extending along a transverse length of facing, opposed side block surfaces, the groove and tongue surfaces contacting and encompassing the two vertical metal support channel flanges, a trough and corresponding horizontal tongue fitting together and aligned with holes in the support channels, the horizontal bracing channels secured between the trough and corresponding horizontal tongue;

a base angle groove running perpendicular to the tongue and groove, the base angle groove located in a bottom face of a bottom block and positioned from a front or a back block surface a dimension equal to a foam thickness from the front or the back of the block to the channel flange; and, a base plate having flanges inserted in a base angle grooves of the blocks;

wherein the base plate flanges are secured to the channel flanges and secured to a building floor adjacent the structural insulating core wall.

9. The structural insulation core wall of claim 8 wherein inner and outer rigid boards are attached to flanges located on both sides of the support channels, the blocks are positioned between the inner and outer rigid boards, the boards fully extend between the support channels and longitudinally extend from the bottom of the support channels to the top of the wall.

* * * * *